US008862041B2

(12) United States Patent
Ueda

(10) Patent No.: US 8,862,041 B2
(45) Date of Patent: Oct. 14, 2014

(54) IMAGE FORMING APPARATUS

(71) Applicant: KYOCERA Document Solutions Inc., Osaka (JP)

(72) Inventor: Hiroyuki Ueda, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 40 days.

(21) Appl. No.: 13/742,686

(22) Filed: Jan. 16, 2013

(65) Prior Publication Data

US 2013/0188976 A1 Jul. 25, 2013

(30) Foreign Application Priority Data

Jan. 23, 2012 (JP) ..... 2012-011253

(51) Int. Cl.

| | |
|---|---|
| ***G03G 15/20*** | (2006.01) |
| ***G03G 13/20*** | (2006.01) |
| ***G03G 15/10*** | (2006.01) |
| *G03G 13/10* | (2006.01) |
| *G03G 15/00* | (2006.01) |

(52) U.S. Cl.

CPC ..... *G03G 15/2092* (2013.01); *G03G 13/20* (2013.01); *G03G 15/10* (2013.01); *G03G 15/2028* (2013.01); *G03G 13/10* (2013.01); *G03G 15/6582* (2013.01)

USPC ..... 399/339; 399/341

(58) Field of Classification Search

CPC ..... G03G 15/2092

USPC ..... 399/339, 341

See application file for complete search history.

(56) References Cited

U.S. PATENT DOCUMENTS

| | | | | |
|---|---|---|---|---|
| 4,541,707 | A * | 9/1985 | Yoshinaga | 399/325 |
| 5,308,730 | A * | 5/1994 | Suzuki et al. | 430/115 |
| 5,401,611 | A * | 3/1995 | Edwards et al. | 430/276.1 |
| 2012/0034003 | A1* | 2/2012 | Oda et al. | 399/320 |
| 2012/0163847 | A1* | 6/2012 | Condello et al. | 399/67 |
| 2012/0251152 | A1* | 10/2012 | Brewington et al. | 399/67 |
| 2012/0301192 | A1* | 11/2012 | Ueda | 399/313 |
| 2013/0189615 | A1* | 7/2013 | Soda | 430/125.3 |

FOREIGN PATENT DOCUMENTS

| | | |
|---|---|---|
| JP | 2001-290382 | 10/2001 |
| JP | 2007-114241 | 5/2007 |
| JP | 2008-90116 | 4/2008 |
| JP | 2009-98474 | 5/2009 |

* cited by examiner

*Primary Examiner* — Benjamin Schmitt

(74) *Attorney, Agent, or Firm* — Gerald E. Hespos; Michael J. Porco; Matthew T. Hespos

(57) ABSTRACT

An image forming apparatus includes an acquiring section configured to acquire image information about the image, an image forming section that uses liquid developer to form the image on the sheet in response to the image information, a fixing device configured to fix the image onto the sheet, and a controller that carries out control to change operation of the fixing device in response to the image information. The fixing device includes a rubbing mechanism configured to rub the image on the sheet. The rubbing mechanism changes rubbing operation in response to the image information under the control of the controller.

14 Claims, 22 Drawing Sheets

IMAGE FORMING APPARATUS

The present application claims priority to Japanese Patent Application No. 2012-11253 filed to Japanese Patent Office on Jan. 23, 2012, the contents of which are hereby incorporated by reference.

BACKGROUND

The disclosure herein relates to an image forming apparatus for forming images on sheets.

An image forming apparatus which uses liquid developer is known as a device for forming an image on a sheet. This type of image forming apparatuses typically has a fixing device configured to fix images onto sheets. The fixing device generates high heat in order to melt toner contained in the liquid developer, which is transferred onto the sheet.

It is not necessary for a fixing device to generate heat if the fixing device uses liquid developer which has characteristics such that its components (carrier solution) permeate into a sheet and high-molecular compounds with dispersed pigment therein deposit on the surface of the sheet. However, the present inventors discovered disadvantageous properties which are likely to cause peel-off of an image formed on the sheet by means of such liquid developer.

The inventors of the present application proposed a non-thermal fixing method for preventing peel-off of an image from a sheet. According to researches of the inventor, if an image formed with the liquid developer is rubbed on a sheet, the image is less likely to be peeled off from the sheet. According to various researches of the inventors, as a time period for rubbing an image increases, a fixation ratio of the image on a sheet increases. In addition, as a number of rubbing directions on a sheet increases, the fixation ratio of an image on the sheet increases.

An increase in the rubbing level for an image contributes to improving a fixation ratio of the image whereas excessive rubbing may adversely interfere with conveyance of a sheet. In view of the aforementioned findings, the excessive rubbing to an image may cause various drawbacks such as jam, wrinkles or damages of sheets.

An object of the disclosure is to provide an image forming apparatus which achieves a high fixation ratio under an appropriate rubbing condition.

SUMMARY

An image forming apparatus according to one aspect of the disclosure includes an acquiring section configured to acquire image information about the image, an image forming section which uses liquid developer to form the image on the sheet in response to the image information, a fixing device configured to fix the image onto the sheet, and a controller which carries out control to change operation of the fixing device in response to the image information. The fixing device includes a rubbing mechanism configured to rub the image on the sheet. The rubbing mechanism changes rubbing operation in response to the image information under the control of the controller.

DETAILED DESCRIPTION

Exemplary image forming apparatuses are described with reference to the accompanying drawings. Directional terms used hereinafter such as "upper/above", "lower/below", "left" and "right" are merely to clarify description. Therefore, the drawings and the following details do not limit principles of the image forming apparatus and method.

<Fixation Method>

Figure 1A:
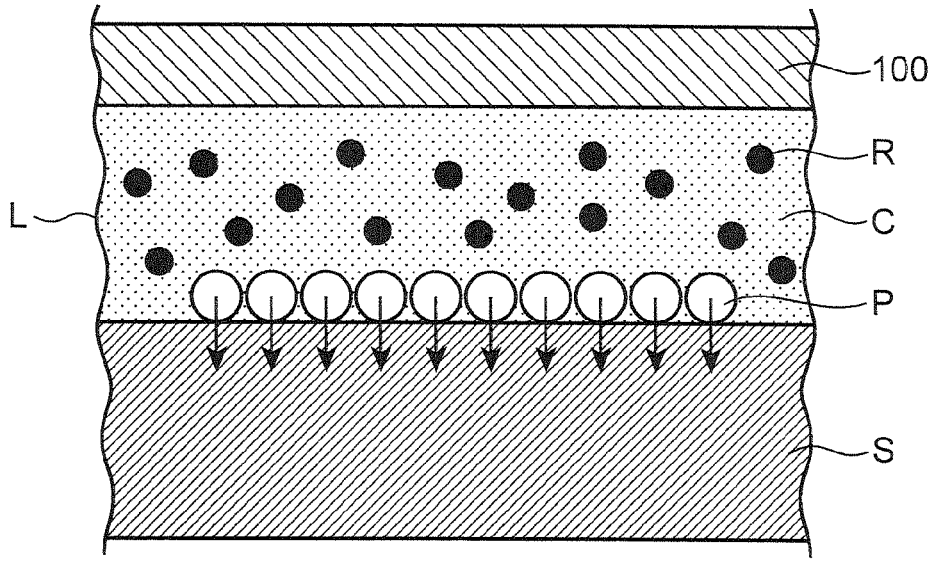
FIG. 1A is a schematic view of an image transfer process with liquid developer.
Figure 1B:
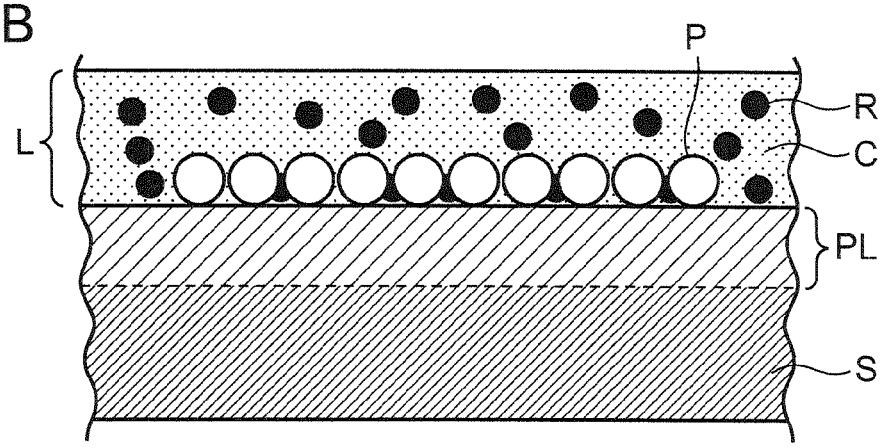
FIG. 1B is a schematic view of the image transfer process with liquid developer.
Figure 1C:
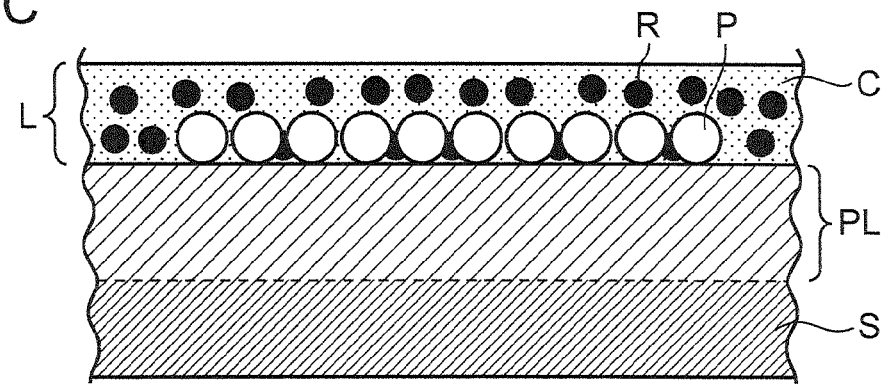
FIG. 1C is a schematic view of the image transfer process with liquid developer.

FIGS. 1A to 1C schematically show a transfer process for transferring an image obtained by means of liquid developer, respectively. The transfer process is sequentially performed in the order of FIGS. 1A to 1C. The image transfer to a sheet and the image obtained after the transfer are described with reference to FIGS. 1A to 1C.

FIG. 1A is a schematic cross-sectional view showing a liquid layer L of liquid developer, which forms an image transferred from an image carrier 100 to a sheet S. For example, the image carrier 100 may be a transfer belt equipped in an image forming apparatus (e.g., a printer, copier, facsimile device or complex machine with their functions), which uses the liquid developer to form images. The image carrier 100 conveys the liquid layer L of the liquid developer to a transfer position at which the liquid layer L is transferred to the sheet S to form the image on the sheet.

The sheet S comes into contact with the liquid layer L on the image carrier 100 at the transfer position. The liquid layer L of the liquid developer, which is used for forming the image, includes carrier liquid C, colored particles P for coloring an image, and polymer compounds R dissolved or swollen in the carrier liquid C. The colored particles P, which are dispersed in the carrier liquid C, are electrostatically attracted to the sheet S. Thus, the colored particles P adhere to the sheet S and form an image. For example, the attraction of the colored particles P to the sheet S is accomplished by an electric field across the sheet S. Principles about the attraction of the colored particles P to the sheet S are described in details in the context of the following image forming apparatus.

FIG. 1B schematically shows the carrier liquid C permeating into the sheet S. The carrier liquid C with low kinetic viscosity permeates into the sheet S to form a permeation layer PL in a surface layer of the sheet S. The polymer compounds R in the liquid layer L of the liquid developer become more concentrated as the carrier liquid C permeates into the sheet S.

As shown in FIG. 1C, when the carrier liquid C further permeates into the sheet S, the polymer compounds R of the liquid layer L deposit on the surface of the sheet S. As described above, the colored particles P electrostatically adhere to the sheet S before the deposition of the polymer compounds R. Therefore, the polymer compounds R depositing on the surface of the sheet S form a coating layer, which is laminated on the layer of the colored particles P that forms the image on the sheet S.

Figure 2A:
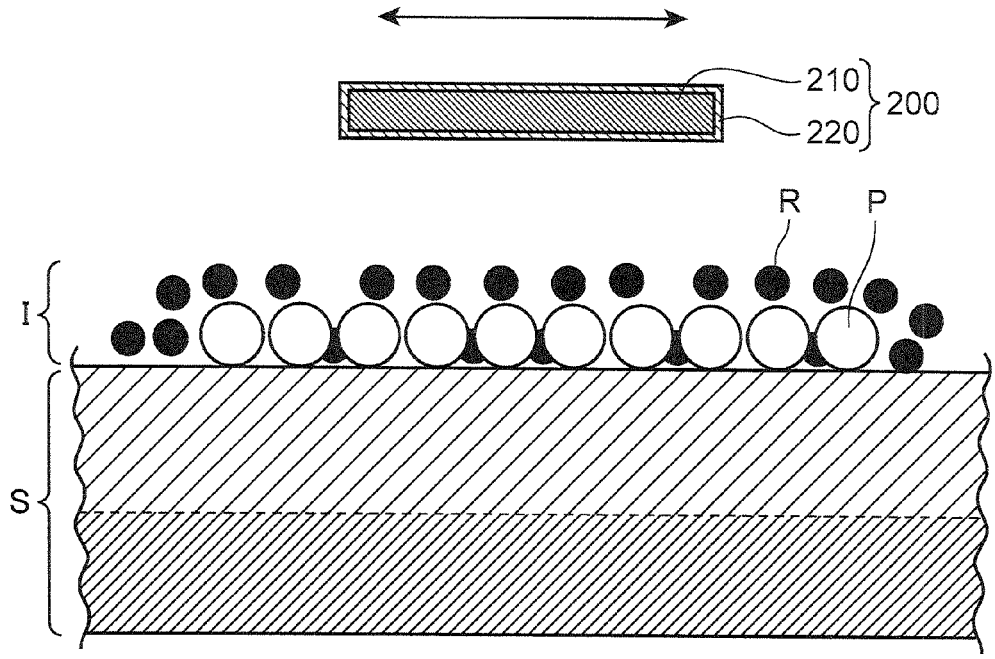
FIG. 2A is a schematic view of a fixation process after the transfer process.
Figure 2B:
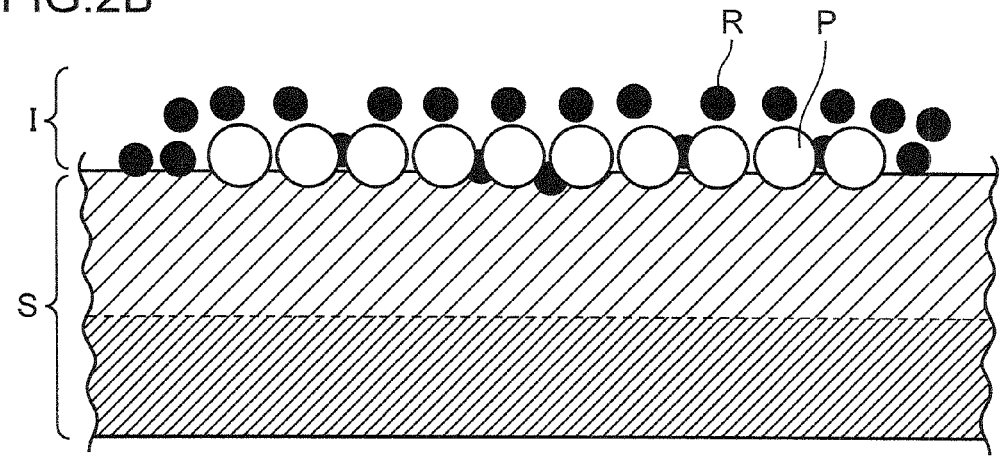
FIG. 2B is a schematic view of the fixation process after the transfer process.

FIGS. 2A and 2B schematically show a fixation process after the transfer process. FIG. 2A schematically shows the fixation process. FIG. 2B is a schematic cross-sectional view of the sheet S after the fixation process. Principles about the fixation process is described with reference to FIGS. 1A to 2B.

After the transfer process, the carrier liquid C substantially permeates into the sheet S, so that an image layer I with the polymer compounds R and the colored particles P is formed on the sheet S. In the transfer process, the image layer I is not subjected to any physical force except for a pressure and electric field generated during the transfer of the liquid layer L (image) from the image carrier 100 to the sheet S. Therefore, before the fixation process, a physical bond between the image layer I and the sheet S is weak, so that the image layer I may be noticeably peeled off as a result of the following peel test using a tape.

FIG. 2A shows a rubbing plate 200, which is used for rubbing an image. For example, the rubbing plate 200 has a substantially rectangular board 210, and a nonwoven fabric 220 covering the surface of the board 210. In the present embodiment, a polypropylene nonwoven fabric is used as the nonwoven fabric 220. Alternatively, a polytetrafluoroethylene (PTFE) nonwoven fabric having a dynamic friction coefficient of 0.10 (referred to as "PTFE felt A," hereinafter), a polytetrafluoroethylene (PTFE) nonwoven fabric having a dynamic friction coefficient of 0.13 (referred to as "PTFE felt B," hereinafter), a polyester felt, a polyethylene terephthalate felt (referred to as "PET felt," hereinafter), a polyamide felt or a wool felt, may be used as the nonwoven fabric 220.

The rubbing plate 200 placed on the image layer I on the sheet S moves over the image layer I along the upper surface of the sheet S. Consequently, a part of components of the image layer I (the colored particles P and/or the polymer compounds R) engages into the surface layer of the sheet S (anchor effect), as shown in FIG. 2B. This reinforces a physical bond between the image layer I and the sheet S.

As described above, the upper surface of the image layer I is covered with the polymer compounds R. The cover layer of the polymer compounds R which covers the colored particles P for coloring the image is strengthened by the rubbing operation of the rubbing plate 200. Therefore, the image layer I is appropriately protected. Thus, the image is less likely to be damaged by the rubbing operation of the rubbing plate 200.

EXPERIMENT 1

Figure 3:
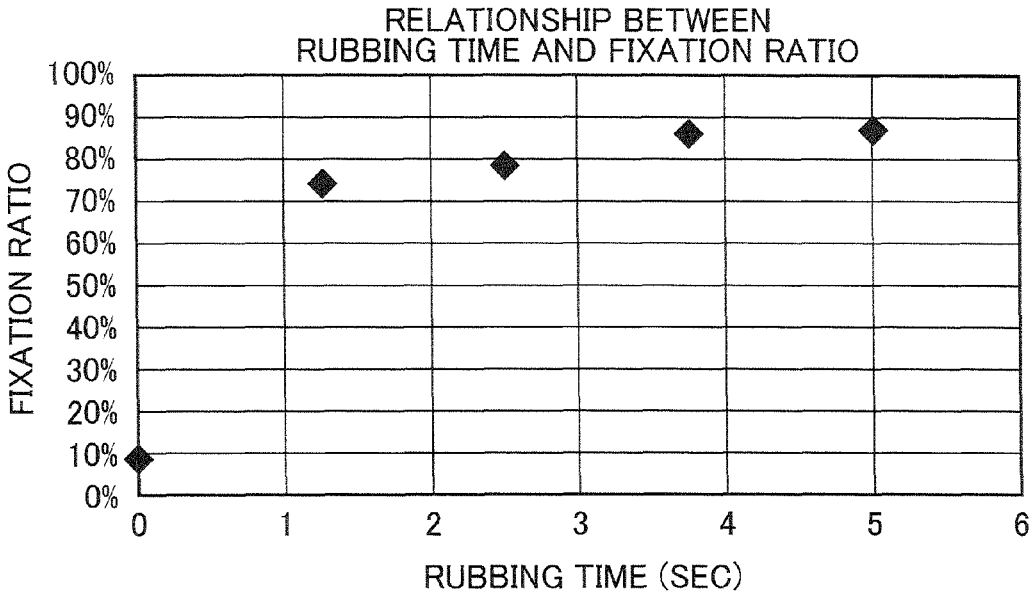
FIG. 3 is a graph schematically showing a relationship between a rubbing/moving time period (rubbing time) for an image layer by a rubbing plate and a fixation ratio of the image layer.

FIG. 3 is a graph schematically showing a fixation ratio of the image layer I against a time period (rubbing time), during which the rubbing plate 200 slides on the image layer I. A relationship between the rubbing time and the fixation ratio is described with reference to FIGS. 2A to 3.

The rubbing time expressed by the horizontal axis of the graph in FIG. 3 indicates a time length during which a given region on the image layer I is in contact with the reciprocating rubbing plate 200.

A fixation ratio FR expressed by the vertical axis of the graph in FIG. 3 is calculated from the following equation, where DO represents density of the image before peeling a tape attached to the image layer I, and D1 represents density of the image after peeling the tape attached to the image layer I.

$$FR\ (\%)=D_1/D_0\times 100 \qquad \text{[Equation 1]}$$

The tape used for evaluating the fixation ratio FR was Mending Tape produced by 3M. The Mending Tape was attached onto the image layer I by means of a dedicated tool. Therefore, attachment strengths between the image layer I in a test sample and the Mending Tape are kept substantially consistent among data points shown in the graph of FIG. 3. The Mending Tape was pressed to the image layer I of the test sample, and then peeled off from the image layer I at a substantially constant peeling angle and substantially constant peeling speed by means of a dedicated tool.

The image density of the test sample was measured by SpectroEye, which is a spectrophotometer produced by Sakata Inx Eng. Co., Ltd.

As shown in FIG. 3, if the image layer I is rubbed for one second or longer, the image layer I may achieve a relatively high fixation ratio FR. Rubbing the image layer I for less than one second indicates a drastic increase in the fixation ratio FR of the image layer I. It should be noted that a weight of the rubbing plate 200 is appropriately determined such that the surface of the image layer I is not damaged.

Figure 4:
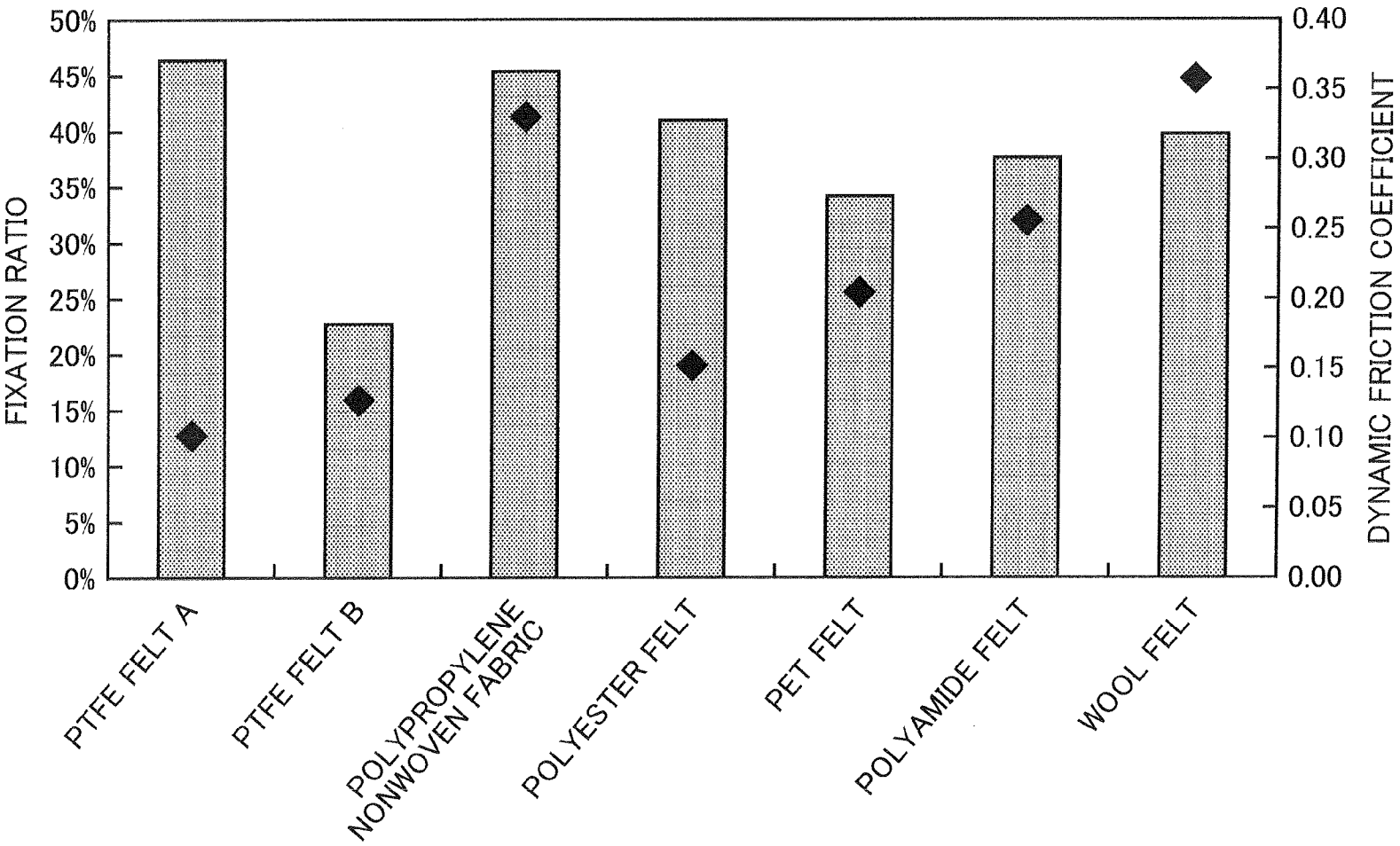
FIG. 4 is a graph schematically showing a relationship between various nonwoven fabrics and fixation ratios.
Figure 5A:
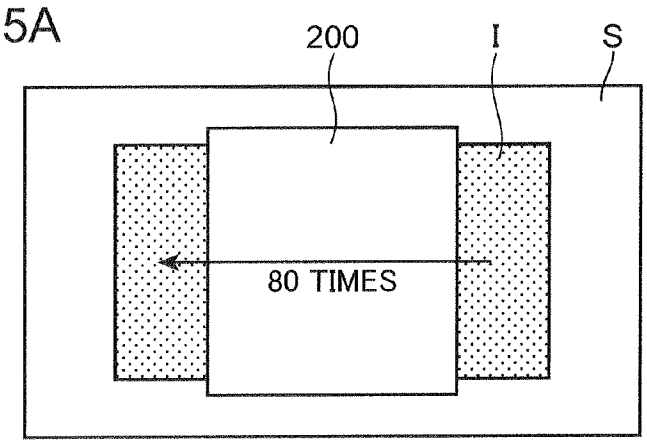
FIG. 5A is a schematic view of an experimental method for investigating effects of a number of rubbing directions on the fixation ratios.
Figure 5B:
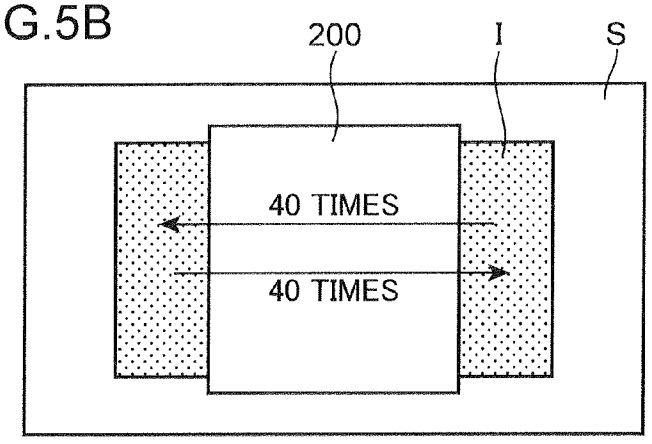
FIG. 5B is a schematic view of an experimental method for investigating effects of a number of rubbing directions on the fixation ratios.
Figure 5C:
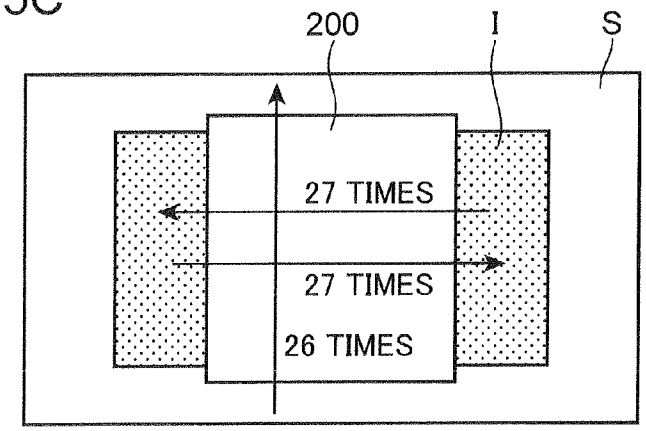
FIG. 5C is a schematic view of an experimental method for investigating effects of a number of rubbing directions on the fixation ratios.
Figure 5D:
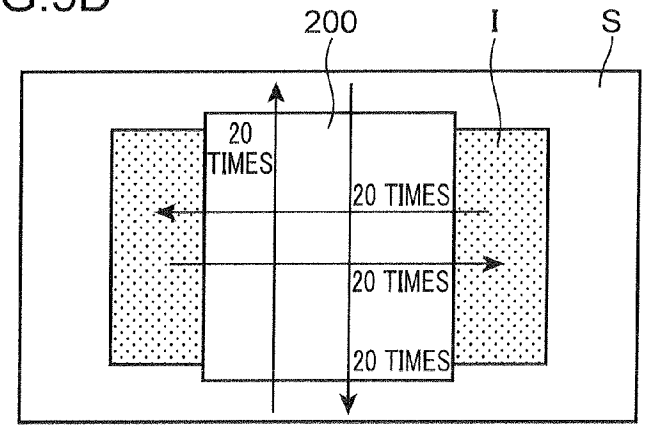
FIG. 5D is a schematic view of an experimental method for investigating effects of a number of rubbing directions on the fixation ratios.

FIG. 4 is a graph schematically showing a relationship between various nonwoven fabrics 220 and the fixation ratios FR. The relationship between the nonwoven fabrics 220 and the fixation ratios FR is described with reference to FIGS. 2A to 4.

The horizontal axis of FIG. 4 represents types of nonwoven fabrics 220. The PTFE felt A, PTFE felt B, polypropylene nonwoven fabric, polyester felt, PET felt, polyamide felt, and wool felt are used in this test.

The left vertical axis of FIG. 4 represents the abovementioned fixation ratios FR. The fixation ratios FR are expressed by bar graphs in FIG. 4. It should be noted that all types of the nonwoven fabrics 220 used in this test achieved high fixation ratios FR in a longer rubbing time than one second. Therefore, the fixation ratios FR shown in FIG. 4 are calculated on the basis of a rubbing time of 0.625 seconds in order to screen out relatively effective types of nonwoven fabrics 220.

The right vertical axis of FIG. 4 represents a dynamic friction coefficient of each nonwoven fabric 220 shown by a dot in FIG. 4. Lower dynamic friction coefficients are advantageous due to less impingement on conveyance of the sheet S and less damage to the image layer I.

As shown in FIG. 4, the PTFE felt A achieves the lowest dynamic friction coefficient and the highest fixation ratio FR. Therefore, it is figured out that the PTFE felt A is the most advantageous among the tested nonwoven fabrics 220. Any nonwoven fabric material, which is not shown in FIG. 4, may be used as the nonwoven fabric 220. Preferably, a nonwoven fabric material with a dynamic friction coefficient of 0.50 or lower is used as the nonwoven fabric 220. It is less likely that such a nonwoven fabric material with the dynamic friction coefficient of 0.50 or lower may impinge on the conveyance of the sheet S and damage to the image layer I.

EXPERIMENT 2

FIGS. 5A to 5D are schematic views showing experimental methods, respectively, for investigating effects of a number of rubbing directions on the fixation ratios FR. FIGS. 5A to 5D exemplifies experimental conditions according to the present embodiment.

In the present experiment, the sheet S on which the image layer I was formed was prepared. The image layer I was rubbed by the rubbing plate 200 like the experiment 1. The image layer I was rubbed under the four conditions shown in FIGS. 5A to 5D. Other experimental conditions were the same as those described in the context of the experiment.

Under the first experimental condition (FIG. 5A), the image layer I was rubbed in a first experimental direction (from the right to the left). The rubbing was continued for 5 seconds. Meanwhile the image layer I was rubbed 80 times.

In the second experimental condition (FIG. 5B), the image layer I was rubbed in the first experimental direction and a second experimental direction (from the left to the right) opposite to the first experimental direction. The rubbing was continued for 5 seconds in total. The image layer I was rubbed 40 times in the first experimental direction and 40 times in the second experimental direction, respectively.

In the third experimental condition (FIG. 5C), the image layer I was rubbed in the first experimental direction, the second experimental direction and a third experimental direction (from the bottom to the top) perpendicular to the first and second experimental directions. The rubbing was continued for 5 seconds in total. Meanwhile the image layer I was rubbed 27 times in the first and second experimental directions, respectively, and 26 times in the third experimental direction.

In the fourth experimental condition (FIG. 5D), the image layer I was rubbed in the first experimental direction, the second experimental direction, the third experimental direction and a fourth experimental direction (from the top to the bottom) opposite to the third experimental direction. The rubbing was continued for 5 seconds in total. Meanwhile the image layer I was rubbed 20 times in the first to fourth directions, respectively.

Figure 6:
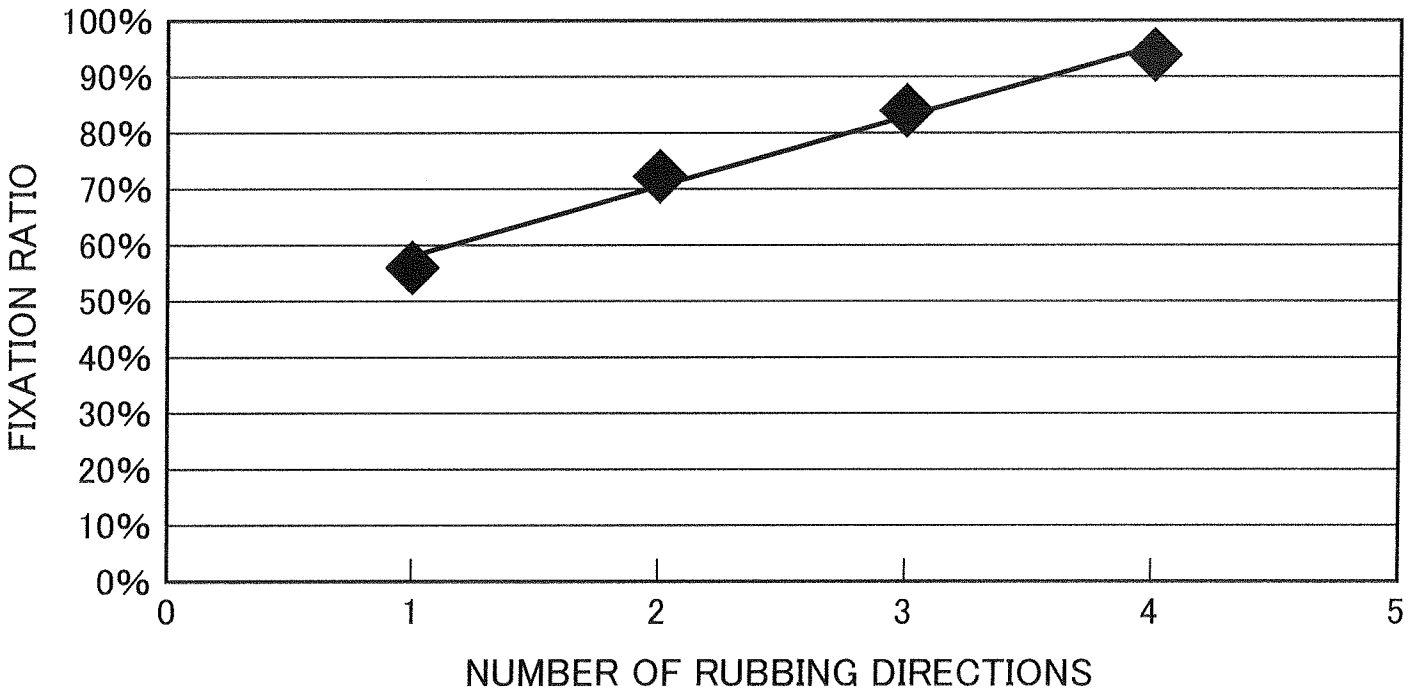
FIG. 6 is a graph showing fixation ratios obtained under the experimental conditions described with reference to FIGS. 5A to 5D.

FIG. 6 is a graph showing fixation ratios FR obtained under the experimental conditions described with reference to FIGS. 5A to 5D. The horizontal axis of the graph shown in FIG. 6 represents a number of the rubbing directions described with reference to FIGS. 5A to 5D. The vertical axis of the graph shown in FIG. 6 represents the fixation ratios FR of the image layer I on the sheet S. A method for calculating the fixation ratios FR shown in FIG. 6 relies on the calculation method described in the context of the experiment 1. The effects of the number of the rubbing directions on the fixation ratios FR are described with reference to FIGS. 5A to 6.

As shown in FIG. 6, the fixation ratio FR linearly went up as an increase in the number of rubbing directions. Under the first experimental condition described with reference to FIG. 5A, the fixation ratio FR was 56%. Under the second experimental condition described with reference to FIG. 5B, the fixation ratio FR was 73%. Under the third experimental condition described with reference to FIG. 5C, the fixation ratio FR was 84%. Under the fourth experimental condition described with reference to FIG. 5D, the fixation ratio FR was 94%.

It is clear from the graph shown in FIG. 6 that the increase in the number of the rubbing directions causes a high fixation ratio FR in a relatively short period of time.

<First Embodiment >

Figure 7:
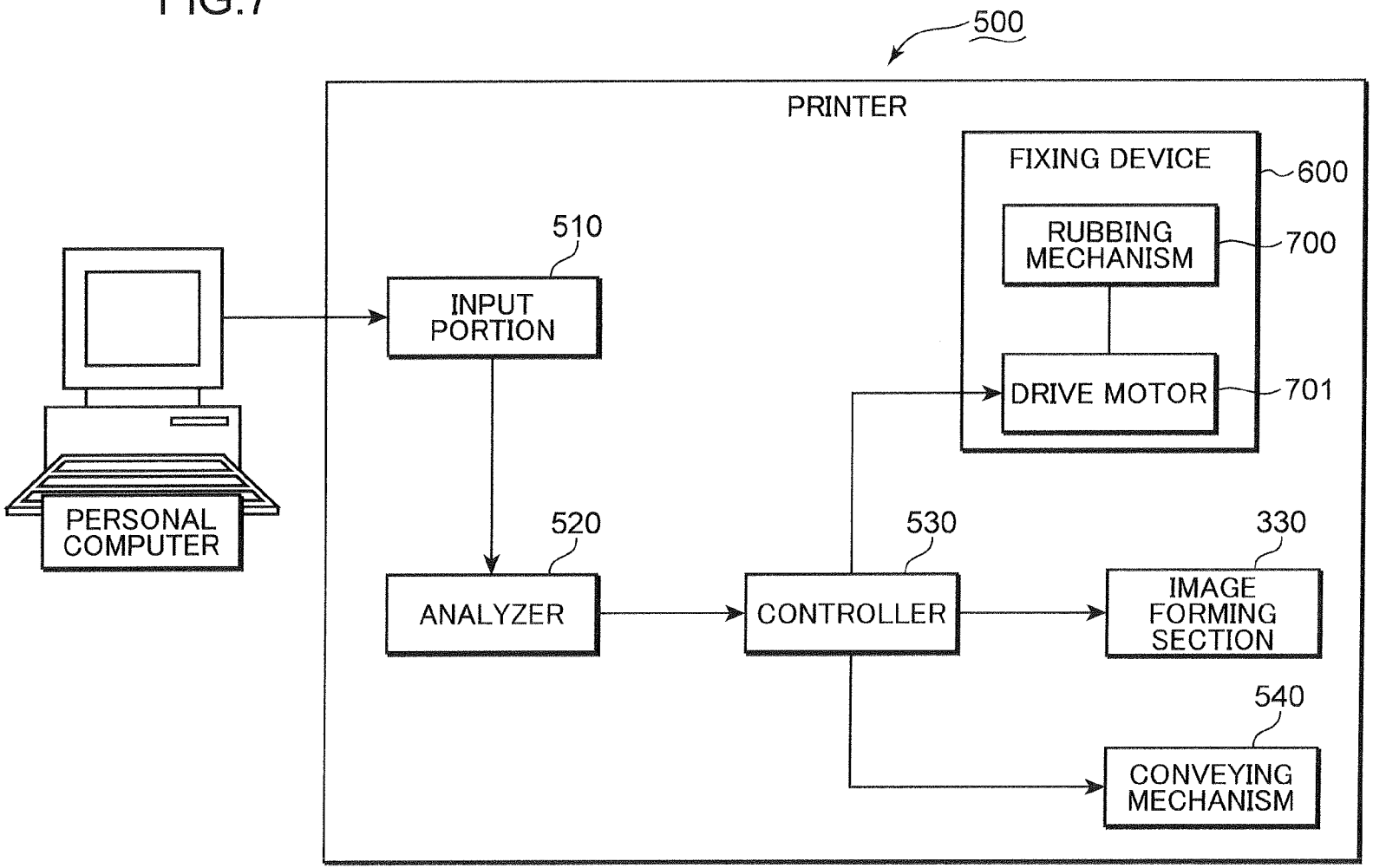
FIG. 7 is a schematic block diagram of an image forming apparatus according to the first embodiment.

FIG. 7 is a schematic block diagram of an image forming apparatus according to the first embodiment. In the present embodiment, the printer 500 is exemplified as the image forming apparatus. The printer 500 is described with reference to FIG. 7. The image forming apparatus may be a copier, a facsimile device, a complex machine with their functions or other device configured to form images on sheets.

The printer 500 is provided with an input portion 510 to which image data about an image to be formed on a sheet are input. In the present embodiment, the image data are generated by an external device such as a personal computer. The input portion 510 is electrically connected to the external device so as to receive the image data. In the present embodiment, the image data output from the personal computer are exemplified as the image information.

The printer 500 is provided with an analyzer 520 configured to analyze the image data. The analyzer 520 receives the image data from the input portion 510.

The image data may include first discrimination information for discriminating whether an image to be formed on a sheet is a monochromatic image or a color image. The image data may include second discrimination information for discriminating whether the image data represent a photographic image or not. The image data may include printing ratio information about a printing ratio of an image to be formed on a sheet.

The analyzer 520 determines which one of a monochromatic image and a color image is formed on the basis of the first discrimination information. The analyzer 520 determines whether an image is formed as a photographic image or not on the basis of the second discrimination information. For instance, the analyzer 520 may analyze the printing ratio by means of an image defined by image data. In the present embodiment, the input portion 510 and the analyzer 520 are exemplified as the acquiring section configured to acquire image information. Alternatively, the acquiring section may be other elements configured to acquire image information such as the first discrimination information, the second discrimination information or the printing ratio information. If the image forming apparatus is a copier, the acquiring section may be a reader configured to read a document, an image memory configured to store image data of the document read by the reader, or a console configured to define a copy mode (e.g. copy at photographing mode, copy at color mode, or copy at monochrome mode).

The printer 500 is provided with a controller 530 configured to control various devices (to be described later) which are necessary for forming images on sheets. The determination by the analyzer 520 and data about an image to be formed on a sheet are output from the analyzer 520 to the controller 530.

The printer 500 is provided with a conveying mechanism 540 configured to convey sheets. Upon receiving signals from the analyzer 520, the controller 530 causes the conveying mechanism 540 to perform a conveying operation. The conveying mechanism 540 conveys a sheet under the control of the controller 530.

The printer 500 is further provided with an image forming section 330 configured to form an image on a sheet by means of liquid developer. The controller 530 controls the image forming section 330 in response to the image data output from the analyzer 520. Accordingly, the image forming section 330 forms an image in response to the image data.

The printer 500 is further provided with a fixing device 600 configured to fix an image on a sheet. The fixing device 600 is provided with a rubbing mechanism 700 including a contact surface configured to contact an image on a sheet, and a drive motor 701 configured to drive the rubbing mechanism 700. The rubbing mechanism 700 in the present embodiment rubs an image on a sheet by means of a relative speed of the contact surface with respect to a sheet conveying speed defined by the conveying mechanism 540. Various rubbing mechanisms 700 will be described later in the context of the present embodiment.

The drive motor 701 defines a speed of the contact surface of the rubbing mechanism 700. As described above, the analyzer 520 determines the image forming mode of the image forming section 330 in response to the image data (e.g. the first discrimination information, the second discrimination information and the printing ratio information). In other words, the analyzer 520 determines whether a photographic image is printed, or determines whether a monochromatic image or a color image is printed. Further, the analyzer 520 calculates a printing ratio in response to an image defined by the image data. The controller 530 changes an operation (i.e. a rotation speed) of the drive motor 701 in response to the determination by the analyzer 520 and/or the printing ratio calculated by the analyzer 520. Consequently, a relative speed of the contact surface of the rubbing mechanism 700 with respect to the sheet conveying speed is changed in response to the image data. In the present embodiment, the change in the relative speed of the contact surface under the control of the controller 530 means a change in the rubbing operation.

(Structure of Fixing Device)

Figure 8:
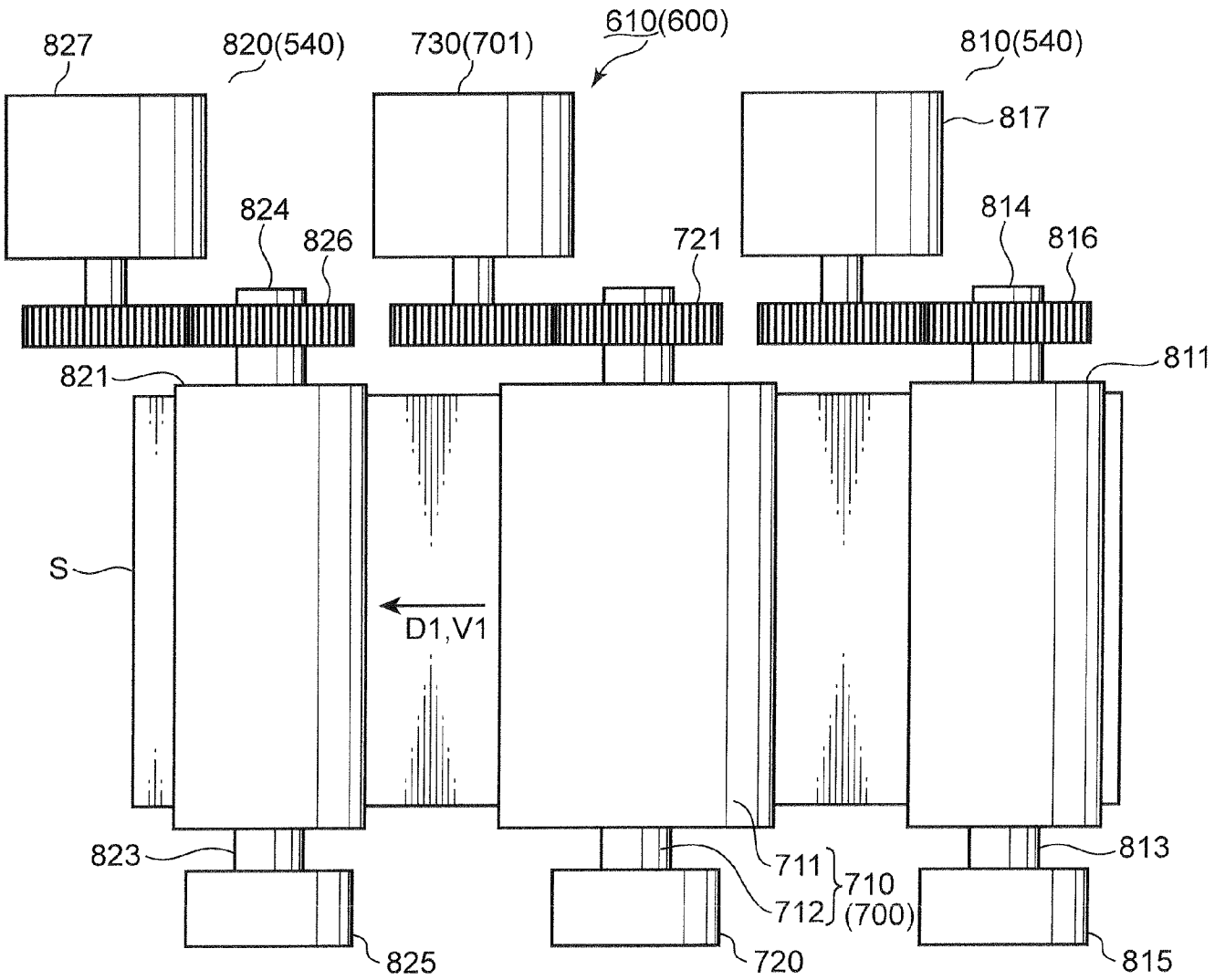
FIG. 8 is a schematic plan view of a mechanism which may be used as a fixing device of the image forming apparatus shown in FIG. 7.

FIG. 8 is a schematic plan view of a mechanism (hereinafter, called as a fixing device 610) which may be used as the fixing device 600 described with reference to FIG. 7. The fixing device 610 is described with reference to FIGS. 7 and 8.

The fixing device 610 is provided with a rubbing roller 710, which may be used as the rubbing mechanism 700. The rubbing roller 710 comes into contact with an upper surface of a sheet S carrying an image. The rubbing roller 710 includes a cylindrical contact tube 711 configured to contact the upper surface of the sheet S, and a shaft 712 projecting from both ends of the contact tube 711. One end of the shaft 712 is rotatably supported by a bearing stored in a housing 720. A gear 721 is mounted on the other end of the shaft 712. An image is formed on the upper surface of the sheet S shown in FIG. 8 by means of liquid developer.

The fixing device 610 is provided with a motor 730 which is coupled to the gear 721. The motor 730 corresponds to the drive motor 701 described with reference to FIG. 7. The motor 730 is operable to change a rotating speed under the control of the controller 530. Therefore, the rotating speed of the contact tube 711 may be changed under the control of the controller 530.

FIG. 8 shows an upstream conveying device 810 situated in an upstream position of the fixing device 610, and a downstream conveying device 820 situated at a downstream position of the fixing device 610. The upstream and downstream conveying devices 810, 820 work as the conveying mechanism 540 described with reference to FIG. 7.

FIG. 8 also shows a vector directing from the upstream conveying device 810 to the downstream conveying device 820. The direction of the vector shown in FIG. 8 is indicated as a conveying direction D1 of the sheet S. A magnitude of the vector shown in FIG. 8 is indicated as a conveying speed V1 of the sheet S. The upstream and downstream conveying devices 810, 820 convey the sheet S in cooperation with each other.

Figure 9:
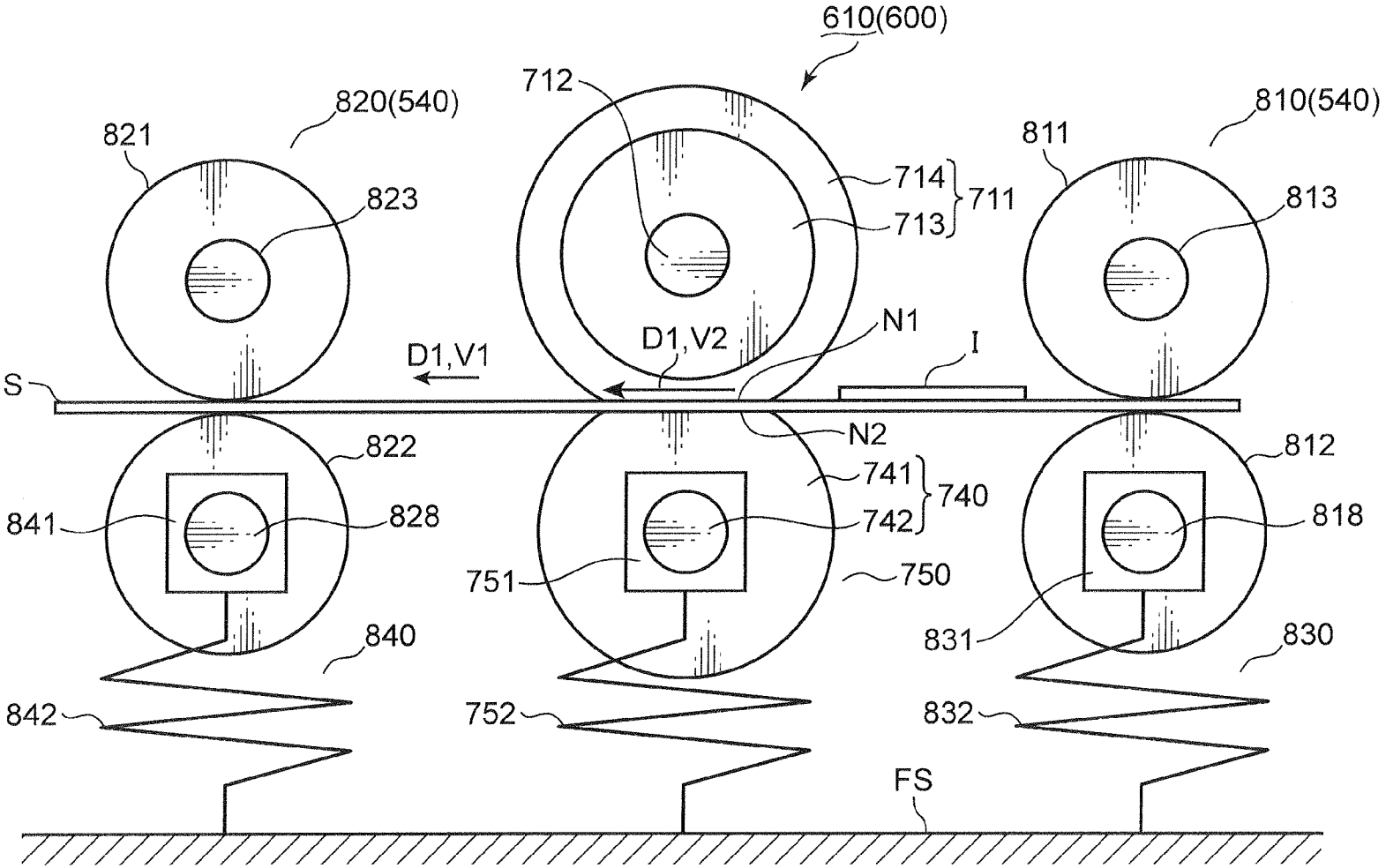
FIG. 9 is a schematic side view of the fixing device shown in FIG. 8.

FIG. 9 is a schematic side view of the fixing device 610. The fixing device 610 is described with reference to FIGS. 4, 8 and 9.

The upstream conveying device 810 includes an upper roller 811 configured to contact an upper surface of a sheet S, and a lower roller 812 configured to contact a lower surface of the sheet S. The upper roller 811 includes a pair of journals 813, 814. The journal 813 is rotatably supported by a bearing stored in a housing 815. A gear 816 is mounted on the journal 814.

The upstream conveying device 810 is provided with an upstream motor 817. The upstream motor 817 is coupled to the gear 816.

The upstream conveying device 810 is provided with an upstream support mechanism 830 configured to elastically support the lower roller 812. The lower roller 812 includes a journal 818 which is connected to the upstream support mechanism 830.

The upstream support mechanism 830 includes a bearing portion 831, which rotatably supports the journal 818, and an elastic member 832 (e.g. a coil spring), which is connected between the bearing portion 831 and a supporting surface FS for supporting the fixing device 610, the upstream conveying device 810 and the downstream conveying device 820. The lower roller 812 which is pressed upwardly by the elastic member 832 holds the sheet S in cooperation with the upper roller 811. Consequently, the sheet S held between the upper and lower rollers 811, 812 is conveyed toward the fixing device 610 by the upstream motor 817.

The downstream conveying device 820 includes an upper roller 821 configured to contact the upper surface of the sheet S, and a lower roller 822 configured to contact the lower surface of the sheet S. The upper roller 821 includes a pair of journals 823, 824. The journal 823 is rotatably supported by a bearing stored in a housing 825. A gear 826 is mounted on the journal 824.

The downstream conveying device 820 is provided with a downstream motor 827. The downstream motor 827 is coupled to the gear 826.

The downstream conveying device 820 is provided with a downstream support mechanism 840 configured to elastically support the lower roller 822. The lower roller 822 includes a journal 828 which is connected to the downstream support mechanism 840.

The downstream support mechanism 840 includes a bearing portion 841, which rotatably support the journal 828, and an elastic member 824 (e.g. a coil spring) which is connected between the bearing portion 841 and the supporting surface FS for supporting the fixing device 610, the upstream conveying device 810 and the downstream conveying device 820. The lower roller 822 which is pressed upwardly by the elastic member 842 holds the sheet S in cooperation with the upper roller 821. Consequently, the sheet S held between the upper and lower rollers 821, 822 is discharged from the fixing device 610 by the downstream motor 827.

As shown in FIG. 9, the contact tube 711 is provided with a substantially cylindrical elastic layer 713 configured to surround the circumferential surface of the shaft 712, and a nonwoven fabric layer 714 configured to cover the outer circumferential surface of the elastic layer 713. The elastic layer 713 may be formed from e.g. sponge or other elastic material having a relatively high flexibility. The nonwoven fabric layer 714 may be formed from e.g. one of the nonwoven fabrics described with reference to FIG. 4.

The fixing device 610 is provided with a backup roller 740 situated below the rubbing roller 710. The backup roller 740 includes a substantially cylindrical support tube 741, which is formed from sponge or other elastic material having a relatively high flexibility, and a metal shaft 742, which is inserted in the support tube 741.

The fixing device 610 includes a pressing mechanism 750 configured to press the backup roller 740 against the rubbing roller 710. The pressing mechanism 750 includes a bearing portion 751, which rotatably supports both ends of the shaft 742 projecting from end surfaces of the support tube 741, and an elastic member 752 (e.g. a coil spring), which is connected between the bearing portion 751 and the supporting surface FS for supporting the fixing device 610, the upstream conveying device 810 and the downstream conveying device 820.

The elastic member 752 biases the backup roller 740 toward the rubbing roller 710. Accordingly, the nonwoven fabric layer 714 and/or the elastic layer 713 press the sheet S to form a substantially flat upper nip surface N1 , which extends along the upper surface of the sheet S passing the fixing device 610, on the circumferential surface of the rubbing roller 710. Likewise, the circumferential surface of the support tube 741 is compressively deformed to form a substantially flat lower nip surface N2, which extends along the lower surface of the sheet S passing through the fixing device 610. In the present embodiment, the upper nip surface N1 configured to contact an image (image layer I) formed on the upper surface of the sheet S is exemplified as the contact surface.

With reference to FIG. 9, the vector above the upper nip surface N1 indicates a moving direction and a moving speed of the upper nip surface N1. The motor 730 rotates the rubbing roller 710 so that the upper nip surface N1 moves in the conveying direction D1 of the sheet S. A rotating speed of the motor 730 is set so that the upper nip surface N1 is moved at a moving speed V2, which is different from the conveying speed V1 defined by the upstream and downstream conveying devices 810, 820. Consequently, the image layer I formed on the sheet S is rubbed on the upper nip surface N1 when the image layer I passes between the upper and lower nip surfaces N1, N2. Therefore, the image layer I is fixed onto the sheet S. The moving speed V2 (i.e. a rotating speed of the rubbing roller 710) of the upper nip surface N1 is changed in response to image data by the controller 530.

Figure 10:
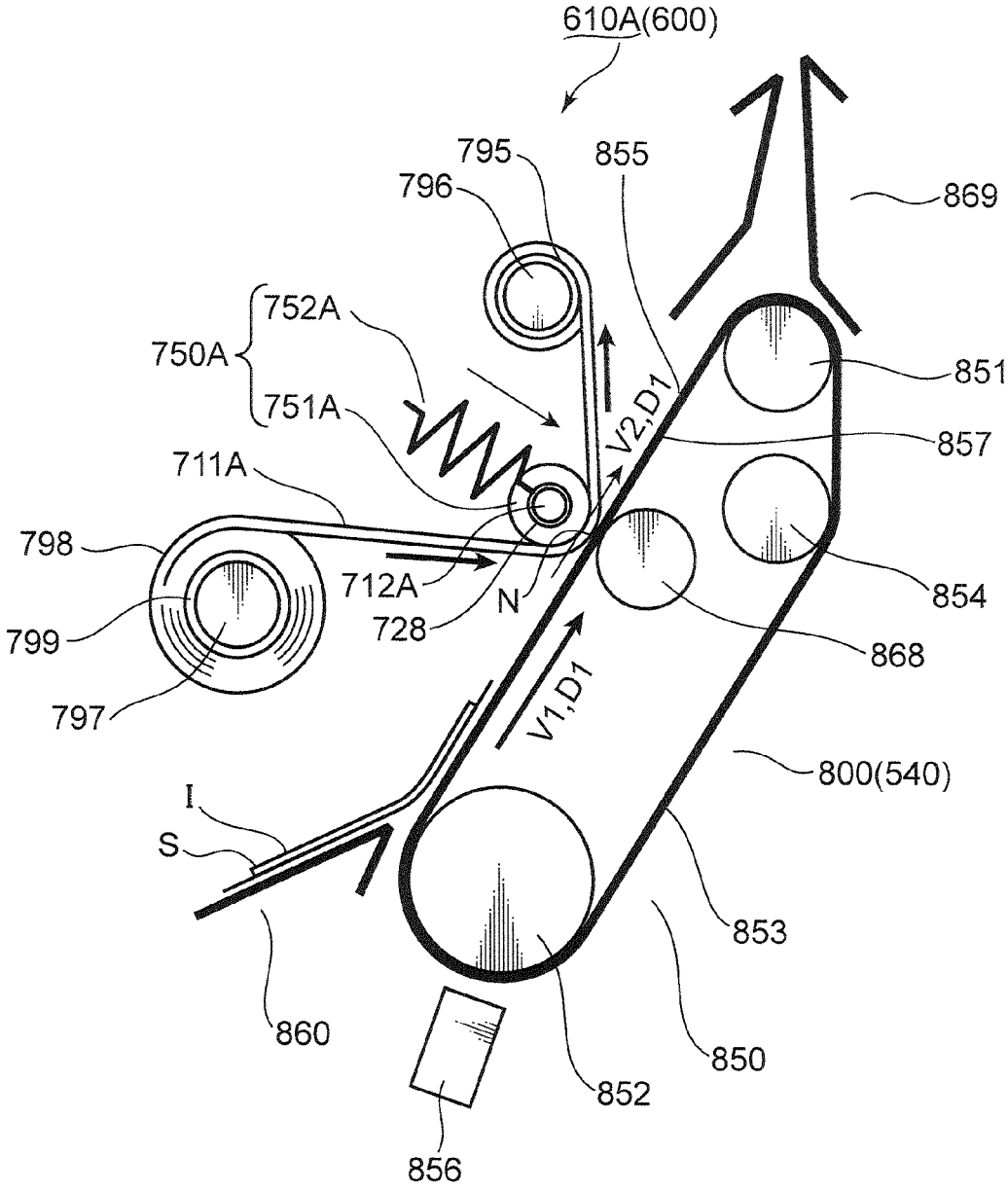
FIG. 10 is a schematic view of a mechanism which may be used as the fixing device of the image forming apparatus shown in FIG. 7.

FIG. 10 is a schematic view of a mechanism (hereinafter, called as a fixing device 610A) which may be used as the fixing device 600 described with reference to FIG. 7. The fixing device 610A is described with reference to FIGS. 4, 7 and 10.

With reference to FIG. 10, the conveying device 800 configured to convey a sheet S carrying an image layer I is exemplified as the conveying mechanism 540. The conveying device 800 is provided with a belt unit 850, an upstream guide unit 860 situated in an upstream position of the belt unit 850, and a downstream guide unit 869 situated in a downstream position of the belt unit 850. The sheet S is guided by the upstream guide unit 860 and fed to the belt unit 850. The sheet S is then fed to the downstream guide unit 869 by the belt unit 850.

The belt unit 850 is provided with a drive roller 851, an idler 852, an endless belt 853 extending between the drive roller 851 and the idler 852, and a tension roller 854 configured to apply tension to the endless belt 853. Rotation of the drive roller 851 causes the endless belt 853 to circulate around the drive roller 851, the idler 852, and the tension roller 854. The idler 852 and the tension roller 854 are rotated as the endless belt 853 circulates. Consequently, the sheet S fed from the upstream guide unit 860 onto the outer surface 855 of the endless belt 853 is directed toward the downstream guide unit 869 as the endless belt 853 circulates. With reference to FIG. 10, a conveying speed of the sheet S directing from the upstream guide unit 860 toward the downstream guide unit 869 is represented by the reference numeral V1.

The belt unit 850 is further provided with a charging device 856 configured to charge the outer surface 855 of the endless belt 853. The outer surface 855 of the endless belt 853 charged by the charging device 856 electrically attracts the sheet S. Therefore, the sheet S is stably conveyed by the endless belt 853. In the present embodiment, the endless belt 853 is preferably made of resin such as PVDF.

The endless belt 853 includes the outer surface 855 to which the sheet S is attracted, and the inner surface 857 opposite to the outer surface 855. The belt unit 850 is provided with a backup roller 868 configured to contact the inner surface 857 of the endless belt 853.

The fixing device 610A is provided with a rubbing band 711A configured to rub the image layer I on the sheet S. The rubbing band 711A is prepared as a nonwoven fabric roll 798 wound around a substantially cylindrical core 799. The rubbing band 711A may be a nonwoven fabric band which uses any of the nonwoven fabrics described with reference to FIG. 4. In the present embodiment, the rubbing band 711A is exemplified as the rubbing belt.

The fixing device 610A is provided with an unwinding spindle 797 loaded with the nonwoven fabric roll 798. The unwinding spindle 797 is inserted through the core 799. The unwinding spindle 797 is preferably provided with a chuck mechanism (not shown) for holding the core 799. The chuck mechanism stably holds the nonwoven fabric roll 798 on the unwinding spindle 797. The rubbing band 711A is unwound from the nonwoven fabric roll 798 loaded on the unwinding spindle 797. The unwinding spindle 797 is rotated as the rubbing band 711A is unwound from the nonwoven fabric roll 798.

The fixing device 610A is provided with a winding spindle 796 which is rotated in cooperation with the unwinding spindle 797. The winding spindle 796 is inserted through a substantially cylindrical core 795. Like the unwinding spindle 797, the winding spindle 796 is provided with a chuck mechanism (not shown) for holding the core 795. An end of the rubbing band 711A unwound from the unwinding spindle 797 is connected to the outer circumferential surface of the core 795. As the winding spindle 796 is rotated, the rubbing band 711A is wound around the core 795. Accordingly, the winding spindle 796 may wind the rubbing band 711A. In the present embodiment, the winding spindle 796 is exemplified as the winder configured to wind the rubbing belt.

The winding and/or unwinding spindles 796, 797 are driven by the drive motor 701 described with reference to FIG. 7. As described above, the drive motor 701 varies a rotating speed under the control of the controller 530. Therefore, the rotating speed of the winding and/or unwinding spindle 796, 797 is changed in response to image data. Accordingly, the winding speed of the rubbing band 711A is changed in response to the image data.

The fixing device 610A is provided with a pressing mechanism 750A configured to contact the rubbing band 711A extending between the unwinding and winding spindles 797, 796 with the image layer I on the sheet S. The pressing mechanism 750A is provided with a pressure roller 751A situated in correspondence with the backup roller 868, and a coil spring 752A configured to bias the pressure roller 751A toward the rubbing band 711A.

After passing between the pressure roller 751A and the endless belt 853, the rubbing band 711A unwound from the unwinding spindle 797 is wound by the winding spindle 796. The coil spring 752A configured to bias the pressure roller 751A toward the endless belt 853 forms a nip portion N for holding the sheet S between the rubbing band 711A and the endless belt 853. When the sheet S passes the nip portion N, the pressure roller 751A causes the rubbing band 711A to press the image layer I so that a contact surface is formed on the rubbing band 711A. The coil spring 752A biases the pressure roller 751A toward the image layer I. In the present embodiment, the pressure roller 751A is exemplified as the pressing member.

The pressure roller 751A is provided with a rotating shaft 712A, and a bearing 728 configured to rotatably hold the rotating shaft 712A. In the present embodiment, as the rubbing band 711A is moved from the unwinding spindle 797 to the winding spindle 796, the pressure roller 751A rotates about the rotating shaft 712A.

In the present embodiment, the winding spindle 796 winds the rubbing band 711A when the endless belt 853 conveys the sheet S. The rubbing band 711A held between the pressure roller 751A and the endless belt 853 is wound in the conveying direction D1 at the winding speed V2 larger than the conveying speed V1 of the sheet S during rotation of the winding spindle 796. A difference between the conveying speed V1 of the sheet S and the winding speed V2 by the winding spindle 796 results in friction between the image layer I and the rubbing band 711A. In the present embodiment, the unwinding spindle 797, the winding spindle 796, the rubbing band 711A, and the pressing mechanism 750A are used as the rubbing mechanism 700 described with reference to FIG. 7.

Figure 11:
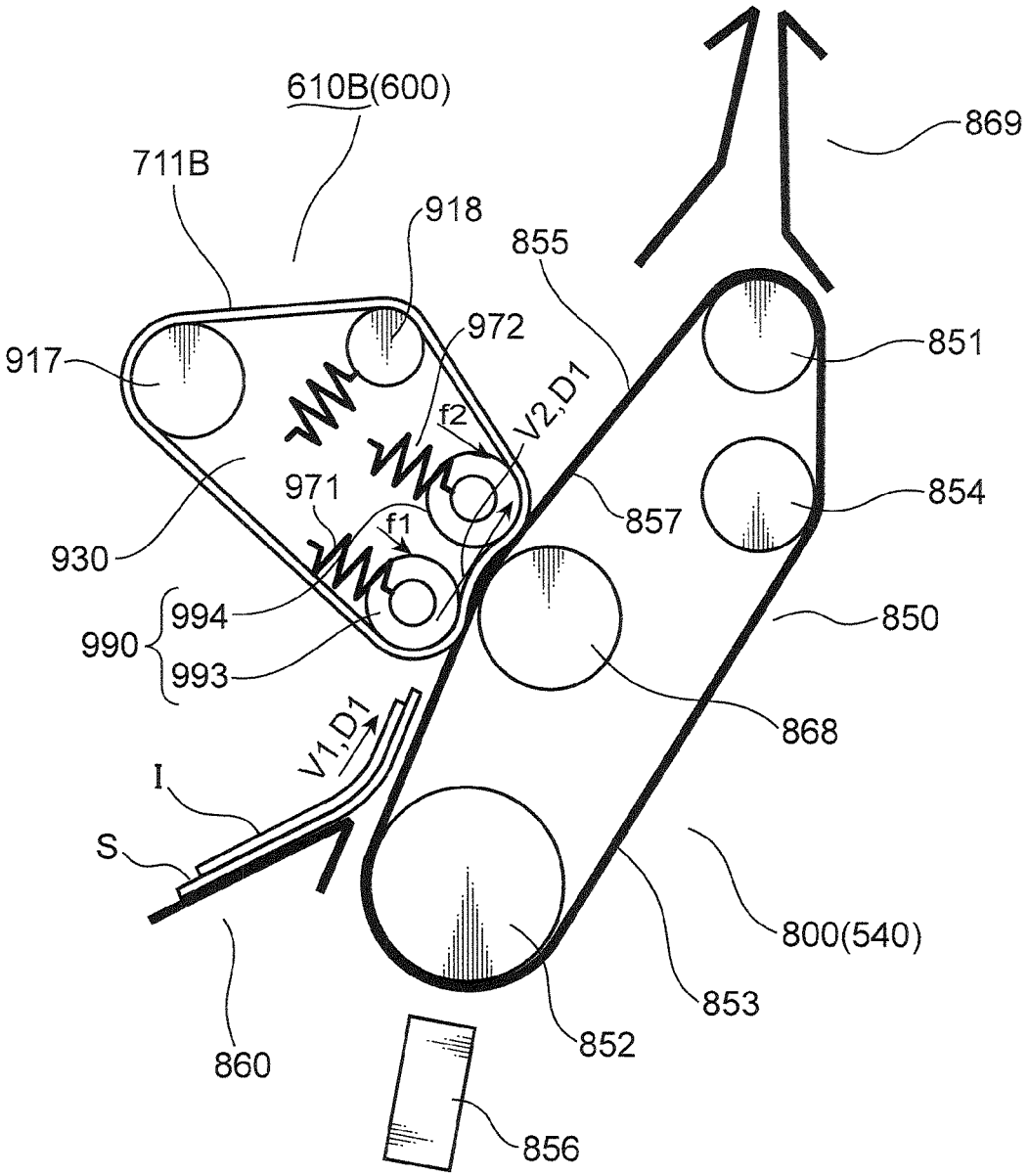
FIG. 11 is a schematic view of a mechanism which may be used as the fixing device of the image forming apparatus shown in FIG. 7.

FIG. 11 is a schematic view of a mechanism (hereinafter, called as a fixing device 610B) which may be used as the fixing device 600 described with reference to FIG. 7. The fixing device 610B is described with reference to FIGS. 4, 7 and 11. In the following, the same reference numerals are used for describing the same elements as those of the aforementioned fixing device. The descriptions in the context of the aforementioned embodiment are preferably incorporated into the elements which are not described hereinafter.

With reference to FIG. 11, the conveying device 800 configured to convey a sheet S carrying an image layer I is exemplified as the conveying mechanism 540. The conveying device 800 is provided with a belt unit 850, an upstream guide unit 860 situated in an upstream position of the belt unit 850, and a downstream guide unit 869 situated in a downstream position of the belt unit 850. The sheet S is guided by the upstream guide unit 860 and fed to the belt unit 850. The sheet S is then fed to the downstream guide unit 869 by the belt unit 850.

The belt unit 850 is provided with a drive roller 851, an idler 852, an endless belt 853 extending between the drive roller 851 and the idler 852, and a tension roller 854 configured to apply tension to the endless belt 853. Rotating the drive roller 851 causes the endless belt 853 to circulate around the drive roller 851, the idler 852, and the tension roller 854. The idler 852 and the tension roller 854 are rotated as the endless belt 853 circulates. Accordingly, the sheet S fed from the upstream guide unit 860 onto the outer surface 855 of the endless belt 853 is directed toward the downstream guide unit 869 as the endless belt 853 circulates. With reference to FIG. 11, a conveying speed of the sheet S directing from the upstream guide unit 860 toward the downstream guide unit 869 is represented by the reference numeral V1.

The belt unit 850 is further provided with a charging device 856 configured to charge the outer surface 855 of the endless belt 853. The outer surface 855 of the endless belt 853 charged by the charging device 856 electrically attracts the sheet S. Therefore, the sheet S is stably conveyed by the endless belt 853. In the present embodiment, the endless belt 853 is preferably made of resin such as PVDF.

The endless belt 853 includes the outer surface 855, to which the sheet S is attracted, and the inner surface 857 opposite to the outer surface 855. The belt unit 850 is provided with a backup roller 868 configured to contact the inner surface 857 of the endless belt 853.

The fixing device 610B includes an annular nonwoven fabric band 711B configured to rub the image layer I on the sheet S, and a roller mechanism 930 configured to circulate the annular nonwoven fabric band 711B. The annular nonwoven fabric band 711B surrounds the roller mechanism 930. The annular nonwoven fabric band 711B may be made of any of the nonwoven fabrics described with reference to FIG. 4. In the present embodiment, the annular nonwoven fabric band 711B is exemplified as the annular rubbing band. In the present embodiment, the roller mechanism 930 is exemplified as the circulation mechanism.

The roller mechanism 930 is provided with a drive roller 917 configured to circulate the annular nonwoven fabric band 711B, a tension roller 918 configured to apply tension to the annular nonwoven fabric band 711B, and a pressing portion 990 configured to press the annular nonwoven fabric band 711B against the image layer I on the sheet S. The drive roller 917 is driven by the drive motor 701 described with reference to FIG. 7. As described above, the drive motor 701 varies a rotating speed under the control of the controller 530. Therefore, the rotating speed of the drive roller 917 is changed in response to image data. Accordingly, the circulation speed of the annular nonwoven fabric band 711B is changed in response to the image data.

The pressing portion 990 is provided with a first pressure roller 933 configured to press the annular nonwoven fabric band 711B against the image layer I, and a second pressure roller 994 configured to press the annular nonwoven fabric band 711B against the image layer I after the first pressure roller 993. The pressing portion 990 is provided with a first coil spring 971 connected to the first pressure roller 993, and a second coil spring 972 connected to the second pressure roller 994. In the present embodiment, the first and second pressure rollers 993, 994 are exemplified as the pressing member.

The first and second pressure rollers 993, 994 define a travel path of the annular nonwoven fabric band 711B along the outer surface 855 of the endless belt 853. As described above, the backup roller 868 defines the travel path of the endless belt 853 bulged toward the roller mechanism 930. The top of the travel path of the endless belt 853 bulged by the backup roller 868 enters between the first and second pressure rollers 993, 994. Accordingly, a long contact surface which comes into contact with the image layer I on the sheet is formed on the annular nonwoven fabric band 711B between the first and second pressure rollers 993, 994.

The first coil spring 971 biases the first pressure roller 993 toward the endless belt 853 by a biasing force f1. The second coil spring 972 biases the second pressure roller 994 toward the endless belt 853 by a biasing force f2. The biasing force f2 is preferably larger than the biasing force f1. Accordingly, the second pressure roller 994 presses the annular nonwoven fabric band 711B against the image layer I with a larger force than the first pressure roller 993.

A layer of polymer compounds deposited on the surface of the image layer I is cured over time to increase scratch resistance. Therefore, if the image layer I is rubbed by the annular nonwoven fabric band 711B at an upstream position with a relatively small pressing force, and is rubbed by the annular nonwoven fabric band 711B at a downstream position with a relatively large pressing force, the image layer I is less likely to be damaged, so that the fixation ratio FR of the image layer I onto the sheet S increases.

The drive roller 917 causes the annular nonwoven fabric band 711B to circulate at the circulation speed V2. As a result of the rotation of the drive roller 917, the annular nonwoven fabric band 711B between the first and second pressure rollers 993, 994 travels in the conveying direction D1 of the sheet S at the circulation speed V2. In the present embodiment, the circulation speed V2 of the annular nonwoven fabric band 711B is set larger than the conveying speed V1 of the sheet S by the belt unit 850. The image layer I is appropriately rubbed by the annular nonwoven fabric band 711B due to a difference between the circulation speed V2 of the annular nonwoven fabric band 711B and the conveying speed V1 of the sheet S.

EXPERIMENT 3

The fixing devices 610, 610A, 610B rub an image on a sheet, by means of a relative speed of a contact surface with respect to a sheet conveying speed. A large relative speed means an increase in the rubbing level for an image on a sheet. The inventor investigated a relationship among the relative speed, the image forming mode and the fixation ratio. The following table shows the relationship among the relative speed, the image forming mode and the fixation ratio.

TABLE 1

| | Image forming mode | | |
|---|---|---|---|
| V2/V1 | Monochromatic image Character image | Monochromatic image Photographic image | Color image |
| 5 | Δ | X | X |
| 10 | ○ | Δ | X |
| 15 | ○ | ○ | X |
| 20 | ○ | ○ | Δ |
| 25 | ○ | ○ | ○ |

Note:
○: no image transfer
Δ: a small degree of image transfer
X: image transfer The inventor set the speed V2, which is described with reference to FIGS. 9 to 11, 5 times, 10 times, 15 times, 20 times, and 25 times as high as the sheet conveying speed V1 to make each test sample.

The inventor prepared a monochromatic character image (i.e. an image other than a photographic image), a monochromatic photographic image and a color image as the test samples. The three types of test samples were made at each of the aforementioned speeds.

The tape used in the experiment was Mending Tape produced by 3M. The Mending Tape was attached onto the image layer by means of a dedicated tool. The Mending Tape was pressed to the image layer of the test sample, and then peeled off from the image layer at a substantially constant peeling angle and substantially constant peeling speed by means of a dedicated tool.

The inventor observed image components adhered to the peeled tape, and classified observation result into three categories as shown in Table 1.

If the monochromatic character image was rubbed at the rubbing speed V2, which was no less than 10 times as high as the sheet conveying speed V1, image transfer onto the tape was not observed. If the monochromatic photographic image was rubbed at the rubbing speed V2, which was no less than 15 times as high as the sheet conveying speed V1, image transfer onto the tape was not observed. If the color image was rubbed at the rubbing speed V2, which was no less than 25 times as high as the sheet conveying speed V1, image transfer onto the tape was not observed.

Figure 12:
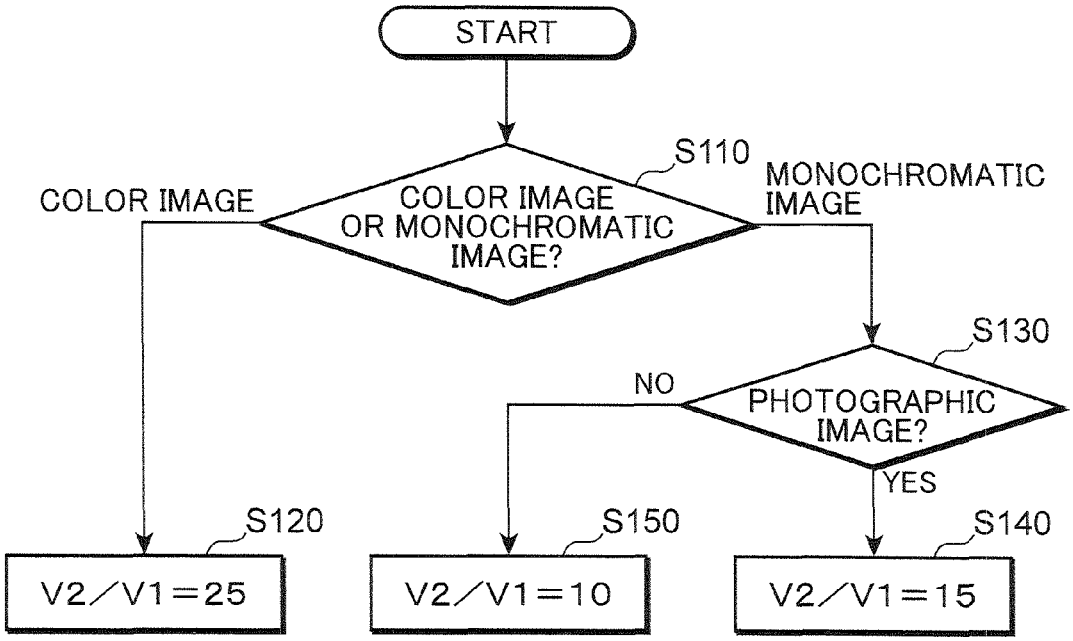
FIG. 12 is a schematic flowchart of an exemplary routine for determining a rubbing speed of the fixing device shown in FIG. 7.

FIG. 12 is a schematic flowchart of an exemplary routine for determining the rubbing speed V2 on the basis of the aforementioned experimental results. The determination routine about the rubbing speed V2 is described with reference to FIGS. 7 and 12.

(Step S110)

In response to input of image data to the printer 500, Step S110 is executed. In Step S110, the analyzer 520 determines whether color or monochromatic image printing is requested on the basis of the first discrimination information of image data. If the color image printing is requested, Step S120 is executed. Otherwise, Step S130 is executed.

(Step S120)

In Step S120, the analyzer 520 determines to set the rubbing speed V2 which is 25 times as high as the sheet conveying speed V1. The determination of the analyzer 520 is output to the controller 530. The controller 530 controls the drive motor 701 to achieve the rubbing speed V2 which is 25 times as high as the sheet conveying speed V1.

(Step S130)

In Step S130, the analyzer 520 determines whether forming an image as a photograph is requested on the basis of the second discrimination information of image data. If forming an image as a photograph is requested, Step S140 is executed. Otherwise, Step S150 is executed.

(Step S140)

In Step S140, the analyzer 520 determines to set the rubbing speed V2 which is 15 times as high as the sheet conveying speed V1. The determination of the analyzer 520 is output to the controller 530. The controller 530 controls the drive motor 701 to achieve the rubbing speed V2 which is 15 times as large as the sheet conveying speed V1.

(Step S150)

In Step S150, the analyzer 520 determines to set the rubbing speed V2 which is 10 times as high as the sheet conveying speed V1. The determination of the analyzer 520 is output to the controller 530. The controller 530 controls the drive motor 701 to achieve the rubbing speed which is 10 times as high as the sheet conveying speed V1.

The analyzer 520 may determine a multiplying factor for the sheet conveying speed V1 in response to a printing ratio before the execution of Step S120, Step S140 and/or Step S150. If a high multiplying factor is set due to an increase in the printing ratio, a high value may be set to the rubbing speed V2. If the printing ratio is low, the analyzer 520 may set a low multiplying factor.

<Second Embodiment >

Figure 13:
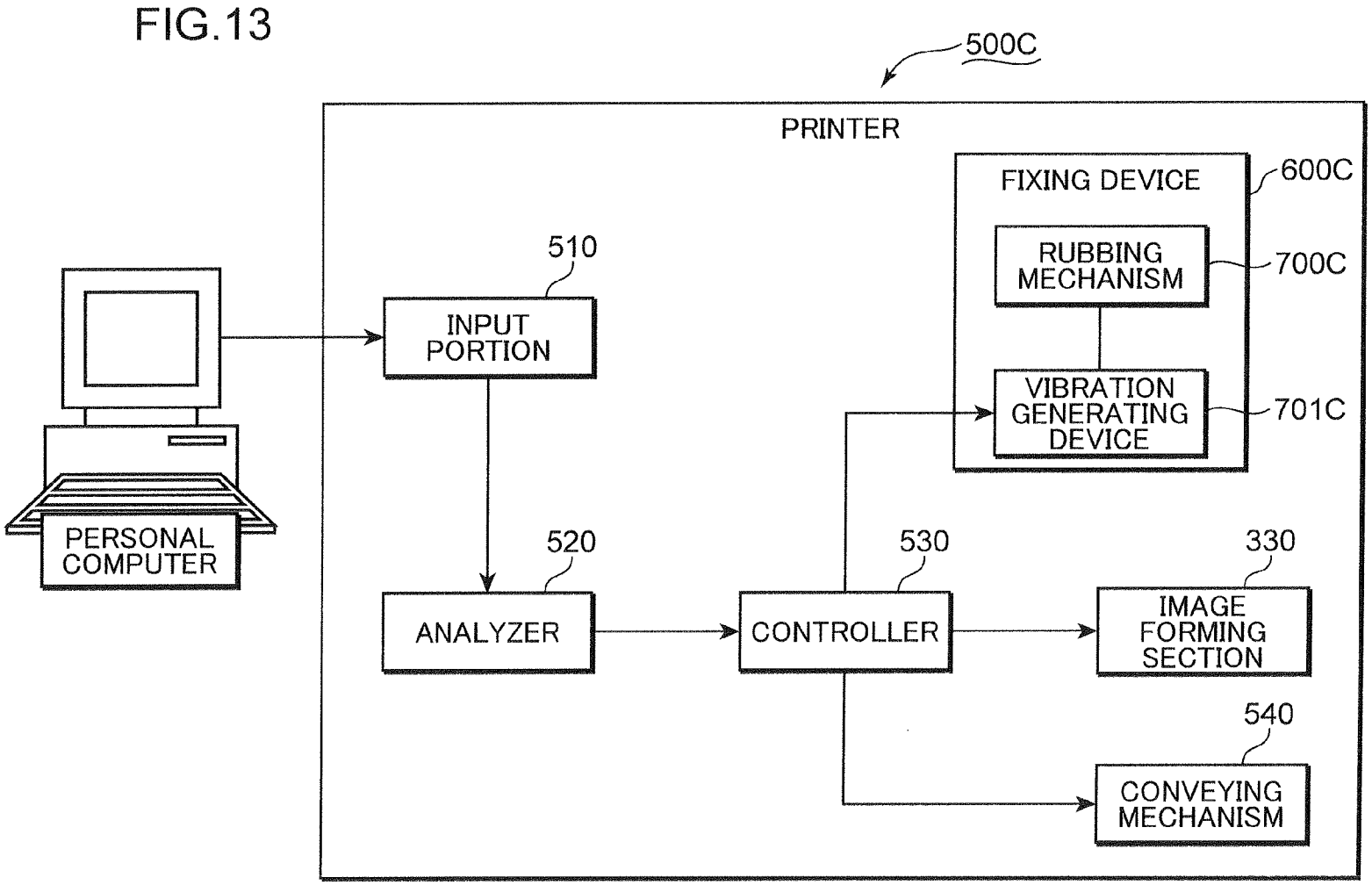
FIG. 13 is a schematic block diagram of an image forming apparatus according to the second embodiment.

FIG. 13 is a schematic block diagram of an image forming apparatus according to the second embodiment. In the present embodiment, a printer 500C is exemplified as the image forming apparatus. The printer 500C is described with reference to FIG. 13. The same reference numerals are used for describing the same elements as those of the printer 500 of the first embodiment, and description about the same elements is omitted herein.

The printer 500C is provided with the input portion 510, the analyzer 520, the controller 530, the conveying mechanism 540, and the image forming section 330, like the printer 500 of the first embodiment. The printer 500C is provided with a fixing device 600C configured to fix an image onto a sheet.

The fixing device 600C is provided with a rubbing mechanism 700C including a contact surface configured to contact an image on a sheet. The fixing device 600C is further provided with a vibration generator 701C configured to vibrate the contact surface of the rubbing mechanism 700C. The rubbing mechanism 700C rubs an image on a sheet by means of the vibration of the contact surface. In the present embodiment, the vibration generator 701C is exemplified as the vibration mechanism.

The vibration generator 701C defines a frequency of the contact surface of the rubbing mechanism 700C. As described above, the analyzer 520 determines the image forming mode of the image forming section 330 in response to image data (e.g. first discrimination information, second discrimination information and printing ratio information). In other words, the analyzer 520 determines whether a photographic image is printed, or determines whether a monochromatic image or a color image is printed. The analyzer 520 calculates a printing ratio in response to an image defined by the image data. The controller 530 changes an operation (i.e. the frequency) of the vibration generator 701C in response to the determination by the analyzer 520 and/or the printing ratio calculated by the analyzer 520. In the present embodiment, a change in the frequency of the contact surface under the control of the controller 530 means a change in the rubbing operation.

(Structure of Fixing Device)

Figure 14:
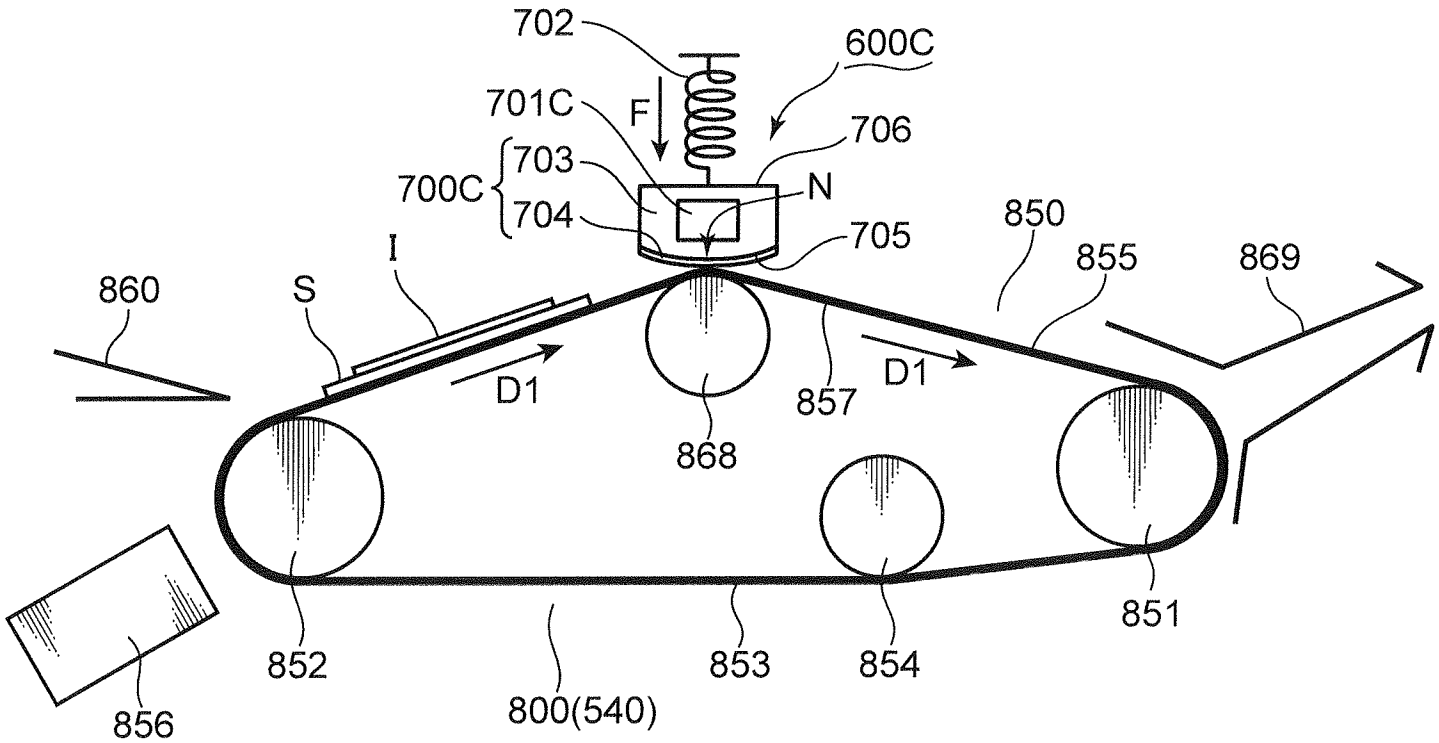
FIG. 14 is a schematic view of a fixing device of the image forming apparatus shown in FIG. 13.
Figure 15:
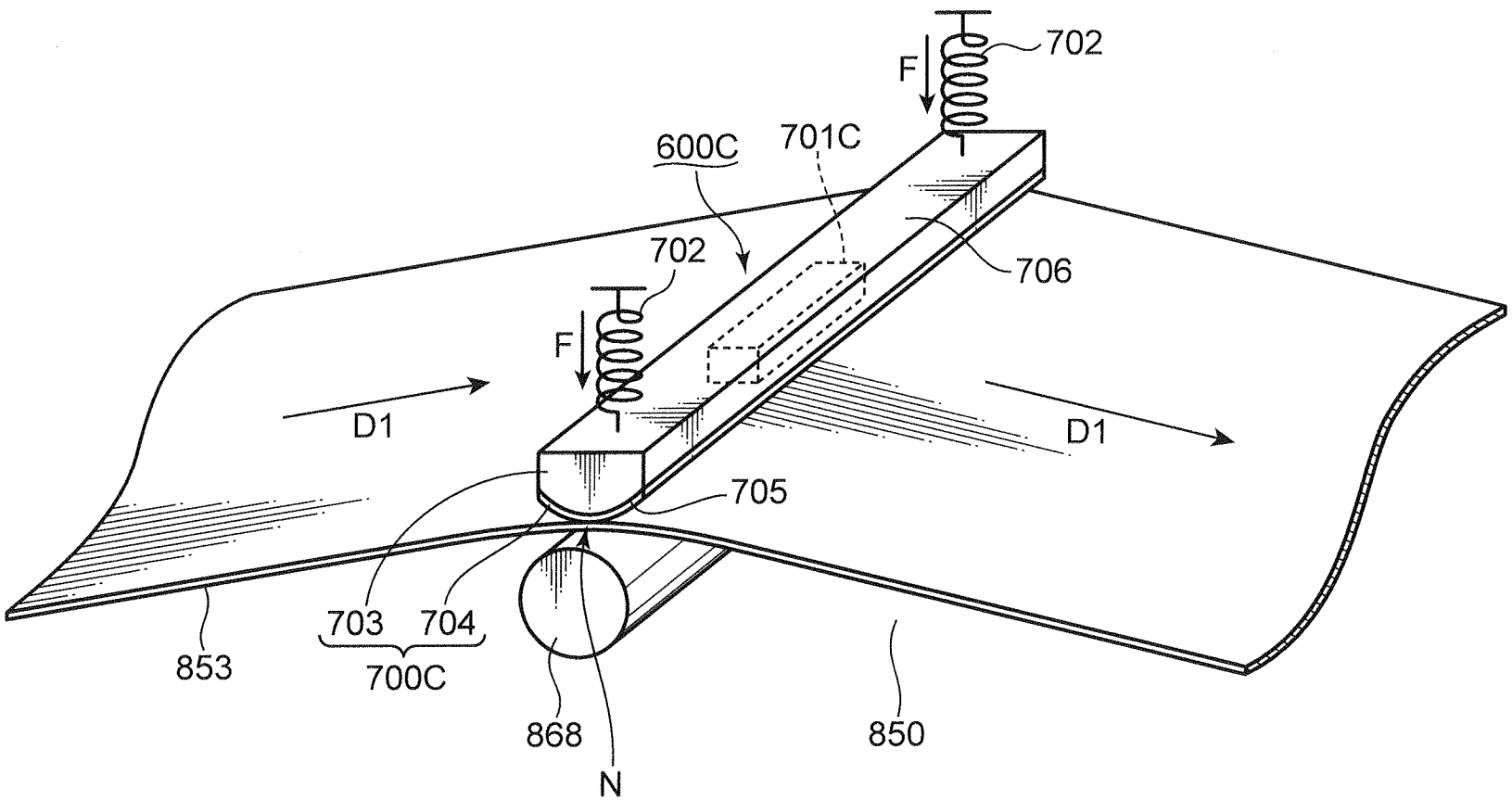
FIG. 15 is a schematic perspective view of the fixing device shown in FIG. 14.

FIG. 14 is a schematic plan view of the fixing device 600C described with reference to FIG. 13. FIG. 15 is a schematic perspective view of the fixing device 600C. The fixing device 600C is described with reference to FIGS. 4, 13 and 15. In the following, the same reference numerals are used for describing the same elements as those of the aforementioned fixing device. The descriptions in the context of the first embodiment are preferably incorporated into the elements which are not described hereinafter.

With reference to FIG. 14, the conveying device 800 configured to convey a sheet S carrying an image layer I is exemplified as the conveying mechanism 540. The conveying device 800 is provided with a belt unit 850, an upstream guide unit 860 situated in an upstream position of the belt unit 850, and a downstream guide unit 869 situated in a downstream position of the belt unit 850. The sheet S is guided by the upstream guide unit 860 and fed to the belt unit 850. The sheet S is then fed to the downstream guide unit 869 by the belt unit 850.

The belt unit 850 is provided with a drive roller 851, an idler 852, an endless belt 853 extending between the drive roller 851 and the idler 852, and a tension roller 854 configured to apply tension to the endless belt 853. Rotating the drive roller 851 causes the endless belt 853 to circulate around the drive roller 851, the idler 852 and the tension roller 854. The idler 852 and the tension roller 854 are rotated as the endless belt 853 circulates. Accordingly, the sheet S fed from the upstream guide unit 860 onto an outer surface 855 of the endless belt 853 is directed toward the downstream guide unit 869 as the endless belt 853 circulates.

The belt unit 850 is further provided with a charging device 856 configured to charge the outer surface 855 of the endless belt 853. The outer surface 855 of the endless belt 853 charged by the charging device 856 electrically attracts the sheet S. Therefore, the sheet S is stably conveyed by the endless belt 853. In the present embodiment, the endless belt 853 is preferably made of resin such as PVDF.

The endless belt 853 includes the outer surface 855, to which the sheet S is attracted, and the inner surface 857 opposite to the outer surface 855. The belt unit 850 is provided with a backup roller 868 configured to contact the inner surface 857 of the endless belt 853.

The sheet S carrying the image layer I is conveyed to the fixing device 600C by the conveying device 800. As described with reference to FIG. 13, the fixing device 600C includes the rubbing mechanism 700C and the vibration generator 701C.

The rubbing mechanism 700C includes a biasing member 702, a supporting member 703, and a nonwoven fabric layer 704. The supporting member 703 is situated near the backup roller 868. The endless belt 853 passes between the backup roller 868 and the supporting member 703. The supporting member 703 is an elongated box extending in a perpendicular direction to the conveying direction of the sheet S. The supporting member 703 has a first supporting surface 705, which faces the endless belt 853, and a second supporting surface 706 opposite to the first supporting surface 705. The first supporting surface 705 is a curved surface bulging toward the endless belt 853 whereas the second supporting surface 706 is a flat surface.

The nonwoven fabric layer 704 rubs the image layer I on the sheet S. The nonwoven fabric layer 704 is formed over the entire first supporting surface 705. The nonwoven fabric layer 704 is formed from any of the nonwoven fabrics described with reference to FIG. 4. The dynamic friction coefficient of nonwoven fabric is set to 0.50 or lower. In the present embodiment, the surface of the nonwoven fabric layer 704 configured to rub the image layer I on the sheet S is exemplified as the contact surface.

The biasing member 702 is e.g. a spring member. The biasing member 702 is mounted on the second supporting surface 706 of the supporting member 703. The paired biasing members 702 are mounted on both ends of the supporting member 703, respectively. The biasing member 702 applies a biasing force F against the supporting member 703 to appropriately keep a contact between the nonwoven fabric layer 704 and the sheet S on the endless belt 853. A nip portion N is formed between the contact surface of the nonwoven fabric layer 704, which contacts the image on the sheet S, and the endless belt 853. The biasing member 702 presses the nonwoven fabric layer 704 against the sheet S with a surface pressure of e.g. 0.2 g/mm2. A layer thickness of the nonwoven fabric layer 704 is appropriately set so as to obtain a smooth contact between the nonwoven fabric layer 704 and the image layer I.

The vibration generator 701C is stored in the supporting member 703. In the present embodiment, a vibration motor is used as the vibration generator 701C.

Figure 16:
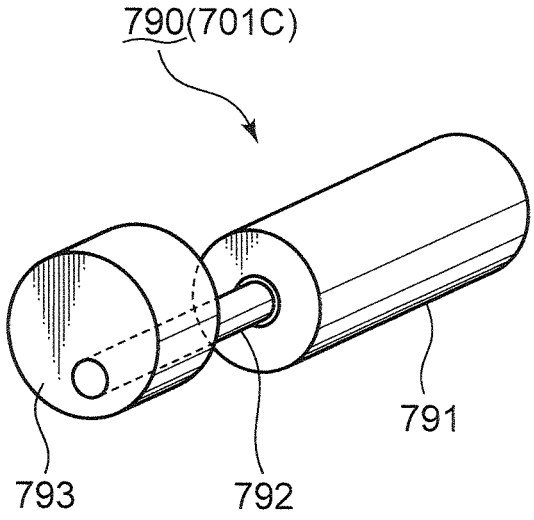
FIG. 16 is a schematic perspective view of a vibration motor which may be used as a vibration generator of the fixing device shown in FIG. 14.

FIG. 16 is a schematic perspective view of the vibration motor 790 which may be used as the vibration generator 701C. The vibration motor 790 is described with reference to FIGS. 13 and 16.

The vibration motor 790 has a main body 791, an output shaft 792, and an eccentric piece 793. The eccentric piece 793 is a weight eccentrically mounted on the output shaft 792. In response to rotation of the output shaft 792, the eccentric piece 793 is eccentrically rotated to cause vibration.

The vibration generated by the vibration motor 790 vibrates the supporting member 703, which internally holds the vibration motor 790, and the nonwoven fabric layer 704 mounted on the first supporting surface 705. The nonwoven fabric layer 704 is pressed toward the endless belt 853 by the biasing member 702 as described above. Therefore, when the sheet S is conveyed to the nip portion N, the nonwoven fabric layer 704 utilizes the vibration to slide on the image layer I in multiple directions and rub the image layer I with keeping in contact with the image layer I.

Figure 17:
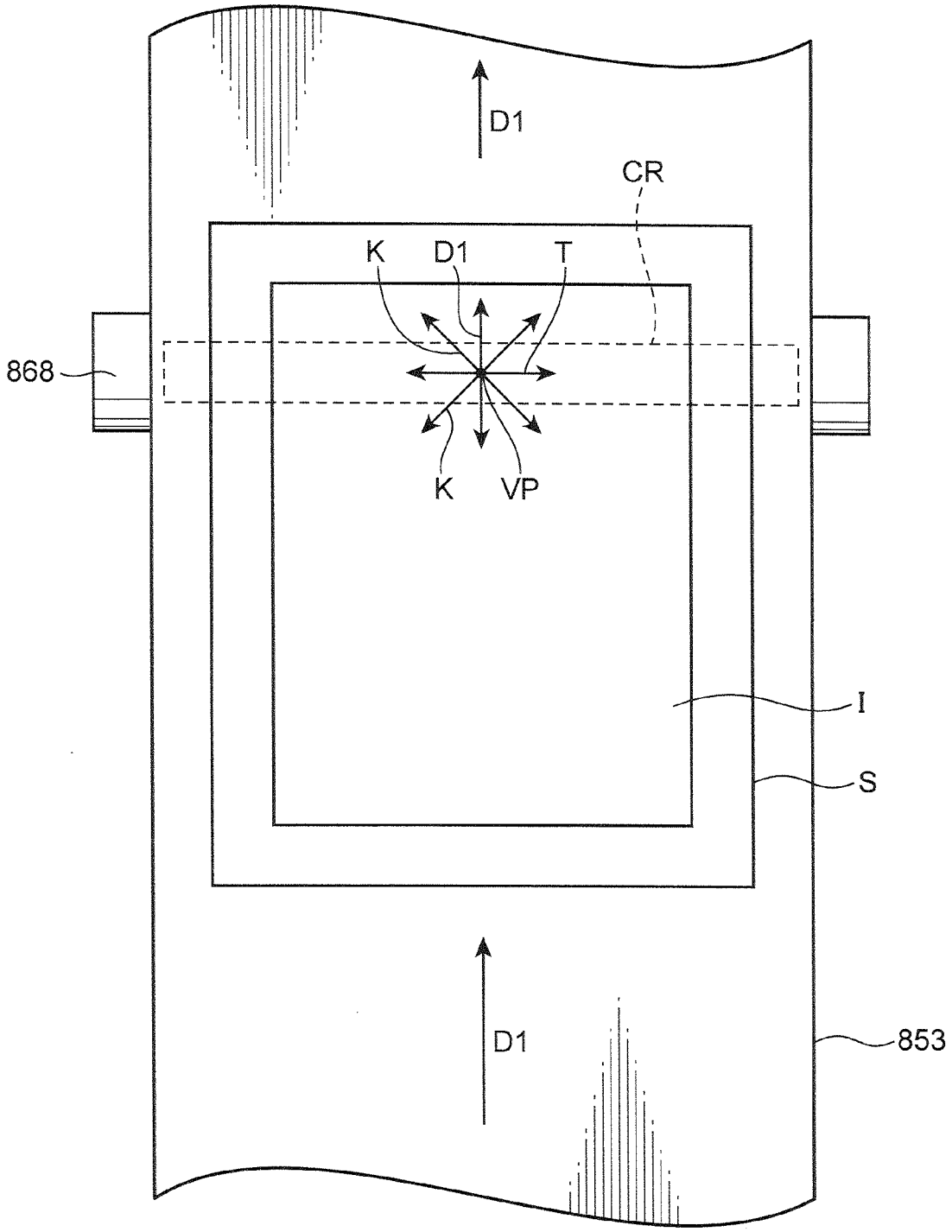
FIG. 17 is a plan view of an endless belt of the image forming apparatus shown in FIG. 13.

FIG. 17 is a plan view of the endless belt 853 carrying the sheet S. FIGS. 13, 15 to 17 schematically show a rubbing operation for the image layer I by the nonwoven fabric layer 704. It should be noted that FIG. 17 does not show the fixing device 600C for clarification.

The nonwoven fabric layer 704 in a rubbing region CR, which is depicted by the dashed line in FIG. 17, contacts the endless belt 853, the sheet S and the image layer I. The rubbing region CR is situated on a line which connects a curvature center of the first supporting surface 705 of the supporting member 703 with the rotation center of the backup roller 868. The rubbing region CR extends in a transverse direction T which is perpendicular to the conveying direction D1 of the sheet S. The rubbing region CR is longer than the width of the sheet S. The nonwoven fabric layer 704 rubs the image layer I with sliding on the image layer I in the rubbing region CR in multiple directions.

FIG. 17 shows a rubbing portion VP defined substantially at the center of the rubbing region CR. The vibration of the nonwoven fabric layer 704 reciprocates the rubbing portion VP with small amplitude in the conveying direction D1 of the sheet S, in the transverse direction T perpendicular to the conveying direction D1 of the sheet S, or in an oblique direction K, which is oblique to the conveying direction D1 or the transverse direction T. The sliding operation of the rubbing portion VP does not have regularity. The rubbing portion VP slides irregularly on the image layer I in multiple directions including these directions D1, T, K with small amplitude to rub the image layer I. Consequently, a part of the image layer I in contact with the rubbing portion VP is rubbed a number of times. It should be noted that the rubbing portion VP does not always reciprocate in these directions D1, T, K.

In the present embodiment, the nonwoven fabric layer 704 in contact with the image layer I is vibrated by the vibration motor 790 to rub the image layer I in multiple directions. Accordingly, the image layer I on the sheet S is rubbed by the nonwoven fabric layer 704 a number of times. Consequently, components in liquid developer forming the image layer I are easily permeated into the outer layer of the sheet S. Therefore, it may take short for the image layer I to be fixed.

EXPERIMENT 4

The fixing device 600C rubs an image on a sheet by means of vibration of a contact surface. A high frequency means an increase in a rubbing level for an image on a sheet. The inventor investigated a relationship among frequency of the contact surface, the image forming mode and the fixing ratio. The following table shows the relationship among the frequency of the contact surface, the image forming mode and the fixing ratio.

TABLE 2

| | Image forming mode | | |
|---|---|---|---|
| Frequency (Hz) | Monochromatic image Character image | Monochromatic image Photographic image | Color image |
| 500 | Δ | X | X |
| 1,000 | ○ | X | X |
| 1,500 | ○ | Δ | X |
| 2,000 | ○ | Δ | X |
| 2,500 | ○ | ○ | Δ |
| 3,000 | ○ | ○ | ○ |

Note:
○: no image transfer
Δ: a small degree of image transfer
X: image transfer The inventor set frequency of the contact surface to 500 Hz, 1,000 Hz, 1,500 Hz, 2,000 Hz, 2,500 Hz and 3,000 Hz to make test samples respectively.

As the test samples, the inventor prepared a monochromatic character image (i.e. an image other than a photographic image), a monochromatic photographic image and a color image. The three types of test samples were made at each of the aforementioned frequencies.

The tape used in the experiment was Mending Tape produced by 3M. The Mending Tape was attached onto the image layer by means of a dedicated tool. The Mending Tape was pressed to the image layer of the test sample, and then peeled off from the image layer at a substantially constant peeling angle and substantially constant peeling speed by means of a dedicated tool.

The inventor observed image components adhered to the peeled tape, and classified the observation result into three categories as shown in Table 2.

If the monochromatic character image was rubbed at a frequency of 1,000 Hz or more, image transfer onto the tape was not observed. If the monochromatic photographic image was rubbed at a frequency of 2,500 Hz or more, image transfer onto the tape was not observed. If the color image was rubbed at a frequency of 3,000 Hz or more, image transfer onto the tape was not observed.

Figure 18:
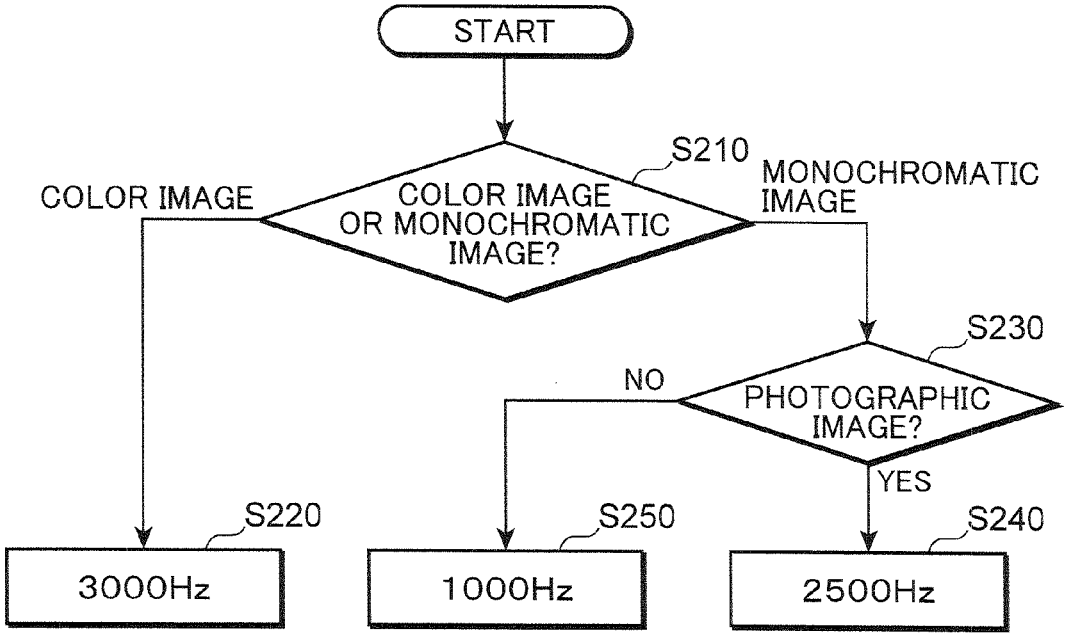
FIG. 18 is a schematic flowchart of an exemplary routine for determining a frequency of the fixing device shown in FIG. 14.

FIG. 18 is a schematic flowchart of an exemplary routine for determining a frequency on the basis of the aforementioned results of the experiment. The determination routine about the frequency is described with reference to FIGS. 13 and 18.

(Step S210)

In response to input of image data to the printer 500C, Step S210 is executed. In Step S210, the analyzer 520 determines whether color or monochromatic image printing is requested on the basis of the first discrimination information of the image data. If the color image printing is requested, Step S220 is executed. Otherwise, Step S230 is executed.

(Step S220)

In Step S220, the analyzer 520 determines to set a frequency of the contact surface to 3,000 Hz. The determination of the analyzer 520 is output to the controller 530. The controller 530 controls the vibration generator 701C to vibrate the contact surface at a frequency of 3,000 Hz.

(Step S230)

In Step S230, the analyzer 520 determines whether it is requested to form an image as a photograph on the basis of the second discrimination information of the image data. If it is requested to form an image as a photograph, Step S240 is executed. Otherwise, Step S250 is executed.

(Step S240)

In Step S240, the analyzer 520 determines to set a frequency of the contact surface to 2,500 Hz. The determination of the analyzer 520 is output to the controller 530. The controller 530 controls the vibration generator 701C to vibrate the contact surface at a frequency of 2,500 Hz.

(Step S250)

In Step S250, the analyzer 520 determines to set a frequency of the contact surface to 1,000 Hz. The determination of the analyzer 520 is output to the controller 530. The controller 530 controls the vibration generator 701C to vibrate the contact surface at a frequency of 1,000 Hz.

The analyzer 520 may determine a frequency of the contact surface in response to a printing ratio before the execution of Step S220, Step 240 and/or Step S250. A high frequency may be set as an increase in the printing ratio. If the printing ratio is low, the analyzer 520 may set a low frequency.

<Third Embodiment >

Figure 19:
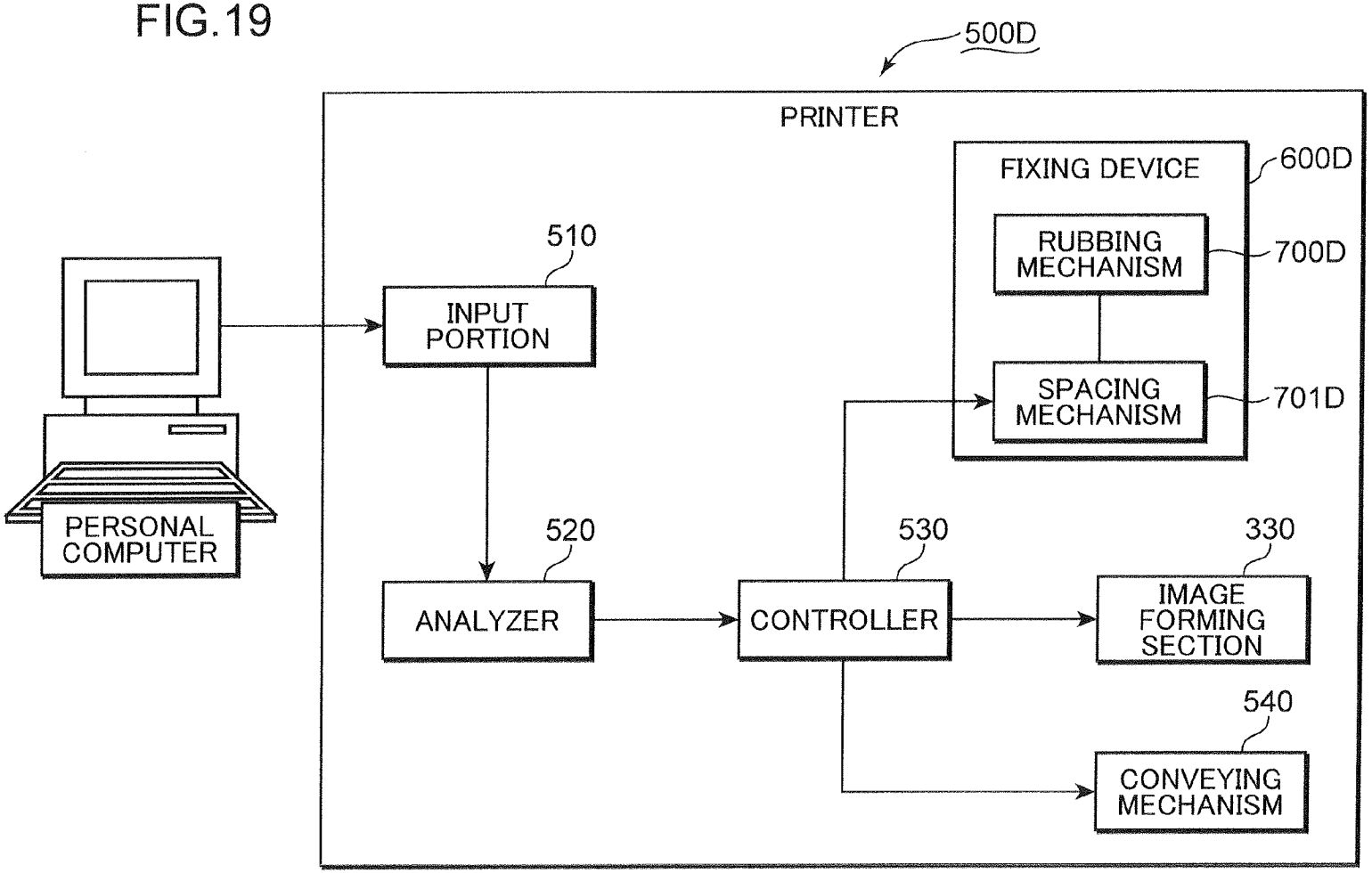
FIG. 19 is a schematic block diagram of an image forming apparatus according to the third embodiment.

FIG. 19 is a schematic block diagram of an image forming apparatus according to the third embodiment. In the present embodiment, the printer 500D is exemplified as the image forming apparatus. The printer 500D is described with reference to FIG. 19. The same reference numerals are used for describing the same elements as those of the printer 500 of the first embodiment, and description about the same elements is omitted herein.

The printer 500D is provided with the input portion 510, the analyzer 520, the controller 530, the conveying mechanism 540, and the image forming section 330, like the printer 500 of the first embodiment. The printer 500D is provided with a fixing device 600D configured to fix an image onto a sheet. The fixing device 600D is provided with a rubbing mechanism 700D including a contact surface configured to contact an image on a sheet, and a spacing mechanism 701D configured to selectively move the rubbing mechanism 700D toward and away from the image on the sheet.

The rubbing mechanism 700D includes a first rubbing portion configured to rub an image on a sheet, and a second rubbing portion configured to rub the image after the first rubbing portion. The spacing mechanism 701D moves one of the first and second rubbing portions away from the image under the control of the controller 530.

As described above, the analyzer 520 determines the image forming mode of the image forming section 330 in response to the image data (e.g. first discrimination information, second discrimination information and printing ratio information). In other words, the analyzer 520 determines whether a photographic image is printed, or determines whether a monochromatic image or a color image is printed. The analyzer 520 calculates a printing ratio in response to an image defined by the image data. The controller 530 changes a spacing operation of the spacing mechanism 701D in response to the determination by the analyzer 520 and/or the printing ratio calculated by the analyzer 520. Accordingly, the spacing operation of the rubbing mechanism 700D for an image is changed in response to the image data. In the present embodiment, a change in the spacing operation under the control of the controller 530 means a change in the rubbing operation.

(Structure of Fixing Device)

Figure 20:
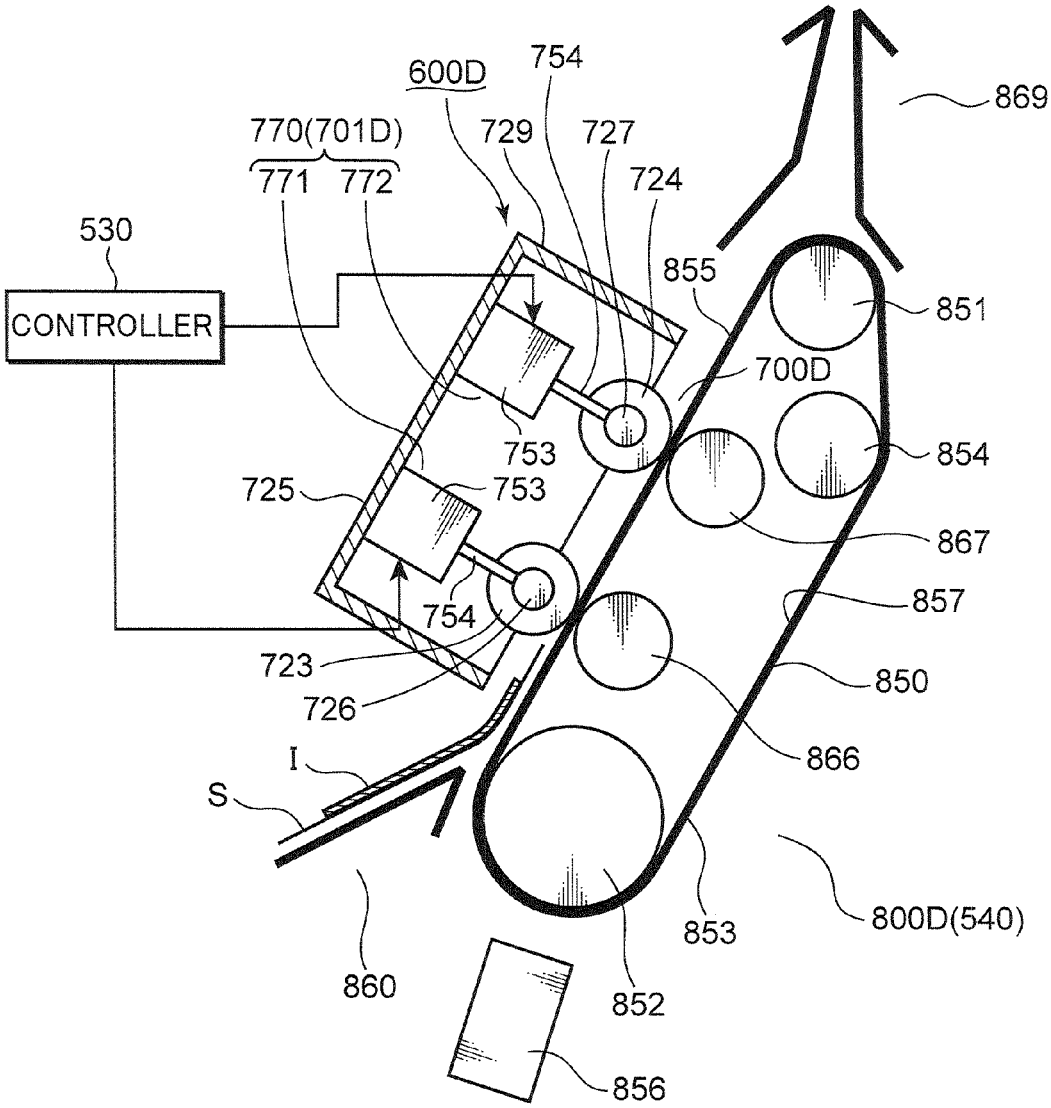
FIG. 20 is a schematic view of a fixing device of the image forming apparatus shown in FIG. 19.

FIG. 20 is a schematic plan view of the fixing device 600D described with reference to FIG. 19. The fixing device 600D is described with reference to FIGS. 4, 19 and 20. In the following, the same reference numerals are used for describing the same elements as those of the aforementioned fixing device. The descriptions in the context of the aforementioned embodiment are preferably incorporated into the elements which are not described hereinafter.

With reference to FIG. 20, the conveying device 800D configured to convey a sheet S which carries an image layer I is exemplified as the conveying mechanism 540. The conveying device 800D is provided with a belt unit 850, an upstream guide unit 860 situated in an upstream position of the belt unit 850, and a downstream guide unit 869 situated in a downstream position of the belt unit 850. The sheet S is guided by the upstream guide unit 860 and fed to the belt unit 850. The sheet S is then fed to the downstream guide unit 869 by the belt unit 850.

The belt unit 850 is provided with a drive roller 851, an idler 852, an endless belt 853 extending between the drive roller 851 and the idler 852, and a tension roller 854 configured to apply tension to the endless belt 853. Rotating the drive roller 851 causes the endless belt 853 to circulate around the drive roller 851, the idler 852 and the tension roller 854. The idler 852 and the tension roller 854 are rotated as the endless belt 853 circulates. Accordingly, the sheet S fed from the upstream guide unit 860 onto an outer surface 855 of the endless belt 853 is directed toward the downstream guide unit 869 as the endless belt 853 circulates.

The belt unit 850 is further provided with a charging device 856 configured to charge the outer surface 855 of the endless belt 853. The outer surface 855 of the endless belt 853 charged by the charging device 856 electrically attracts the sheet S. Therefore, the sheet S is stably conveyed by the endless belt 853. In the present embodiment, the endless belt 853 is preferably made of resin such as PVDF.

The endless belt 853 includes the outer surface 855, to which the sheet S is attracted, and an inner surface 857 opposite to the outer surface 855. The belt unit 850 is provided with backup rollers 866, 867 configured to contact the inner surface 857 of the endless belt 853. The backup roller 866 is situated near the idler 852. The downstream backup roller 867 is situated near the drive roller 851.

The sheet S carrying the image layer I is conveyed to the fixing device 600D by the conveying device 800. As described with reference to FIG. 19, the fixing device 600D includes the rubbing mechanism 700D and the spacing mechanism 701D.

The rubbing mechanism 700D includes an upstream rubbing roller 723 corresponding to the upstream backup roller 866, and a downstream rubbing roller 724 corresponding to the downstream backup roller 867. The downstream rubbing roller 724 rubs the image layer I after the upstream rubbing roller 723. In the present embodiment, the upstream rubbing roller 723 is exemplified as the first rubbing portion. The downstream rubbing roller 724 is exemplified as the second rubbing portion.

The fixing device 600D is provided with a housing 729 configured to store the spacing mechanism 701D. The housing 729 is opened toward the endless belt 853. The upstream and downstream rubbing rollers 723, 724 protrude from the opening of the housing 729 to contact the outer surface 855 of the endless belt 853 or the sheet S.

The fixing device 600D is provided with a cylinder mechanism 770. The cylinder mechanism 770 selectively moves the upstream and downstream rubbing rollers 723, 724 away from the image layer I on the sheet S. In the present embodiment, the cylinder mechanism 770 is exemplified as the spacing mechanism 701D. Alternatively, the spacing mechanism may be any structure configured to selectively move the upstream and downstream rubbing rollers 723, 724 away from the endless belt 853. For instance, the upstream and downstream rubbing rollers 723, 724 may be moved away from the sheet S by means of a lever arm.

The cylinder mechanism 770 includes an upstream cylinder device 771 configured to move the upstream rubbing roller 723 away from the image layer I on the sheet, and a downstream cylinder device 772 configured to move the downstream rubbing roller 724 away from the image layer I on the sheet S.

The cylinder mechanism 770 includes an outer shell 753 configured to allow inflow and outflow of working fluid, and a rod 754 configured to project and retract from and into the outer shell 753. The outer shell 753 is mounted on a top plate 725 of the housing 729. The rod 754 of the upstream cylinder device 771 is mounted on a shaft 726 of the upstream rubbing roller 723. The rod 754 of the downstream cylinder device 772 is mounted on a shaft 727 of the downstream rubbing roller 724.

The fixing device 600D controls the cylinder mechanism 770 under the control of the controller 530. The controller 530 controls the inflow and outflow of working fluid into and from the outer shell 753. If the working fluid flows into the outer shell 753 under the control of the controller 530, the rod 754 projects from the outer shell 753 so that the upstream and/or downstream rubbing rollers 723, 724 are pressed against the image layer I. If the working fluid flows out of the outer shell 753 under the control of the controller 530, the rod 754 retracts into the outer shell 753 so that the upstream and/or downstream rubbing rollers 723, 724 are moved away from the image layer I.

The controller 530 individually controls the upstream and downstream cylinder devices 771, 772. Therefore, the controller 530 is operable to press one of the upstream and downstream rubbing rollers 723, 724 against the image layer I and move the other of the upstream and downstream rubbing rollers 723, 724 away from the image layer I. The controller 530 is also operable to press both of the upstream and downstream rubbing rollers 723, 724 against the image layer I. Optionally, the controller 530 may move the upstream and downstream rubbing rollers 723, 724 away from the image layer I. For instance, the controller 530 may move both of the upstream and downstream rubbing rollers 723, 724 away from the image layer I during non-conveyance of the sheet S.

The operations of the upstream and downstream rubbing rollers 723, 724 may be synchronized with passage of the sheet S. Alternatively, the operations of the upstream and downstream rubbing rollers 723, 724 may be determined on the basis of types of liquid developer or sheet S, which is used for forming the image layer I. For instance, if liquid developer having properties that an image is likely to be damaged is used for forming an image layer I, a position of the upstream and/or downstream rubbing rollers 723, 724 may be controlled so that there is smaller interference between the upstream rubbing roller 723 and the endless belt 853 than interference between the downstream rubbing roller 724 and the endless belt 853.

EXPERIMENT 5

The fixing device 600D rubs an image on a sheet by means of a few contact surfaces. An increase in a number of contact surfaces means an increase in the rubbing level for an image on a sheet. The inventor investigated a relationship among a number of contact surfaces, the image forming mode and the fixation ratio. The following table shows the relationship among a number of contact surfaces, the image forming mode and the fixation ratio.

TABLE 3

| Position of Rubbing Roller | | Image forming mode | |
|---|---|---|---|
| Upstream rubbing roller | Downstream rubbing roller | Monochromatic image | Color image |
| Spaced position | Spaced position | X | X |
| Contact position | Spaced position | ○ | X |
| Spaced position | Contact position | ○ | X |
| Contact position | Contact position | ○ | ○ |

Note:
○: no image transfer
Δ: a small degree of image transfer
X: image transfer The inventor set the upstream and downstream rubbing rollers 723, 724 to a spaced position (position without the roller contacting an image) and a contact position (position where the roller contacts an image) to make test samples respectively.

As the test samples, the inventor prepared a monochromatic image and a color image. The two types of test samples were made at each of the aforementioned positions.

The tape used in the experiment was Mending Tape produced by 3M. The Mending Tape was attached onto the image layer by means of a dedicated tool. The Mending Tape was pressed to the image layer of the test sample, and then peeled off from the image layer at a substantially constant peeling angle and substantially constant peeling speed by means of a dedicated tool.

The inventor observed image components adhered to the peeled tape, and classified the observation result into three categories as shown in Table 3.

If a monochromatic image was rubbed on at least one contact surface, image transfer onto the tape was not observed. If a color image was rubbed on at least two contact surfaces, image transfer onto the tape was not observed.

Figure 21:
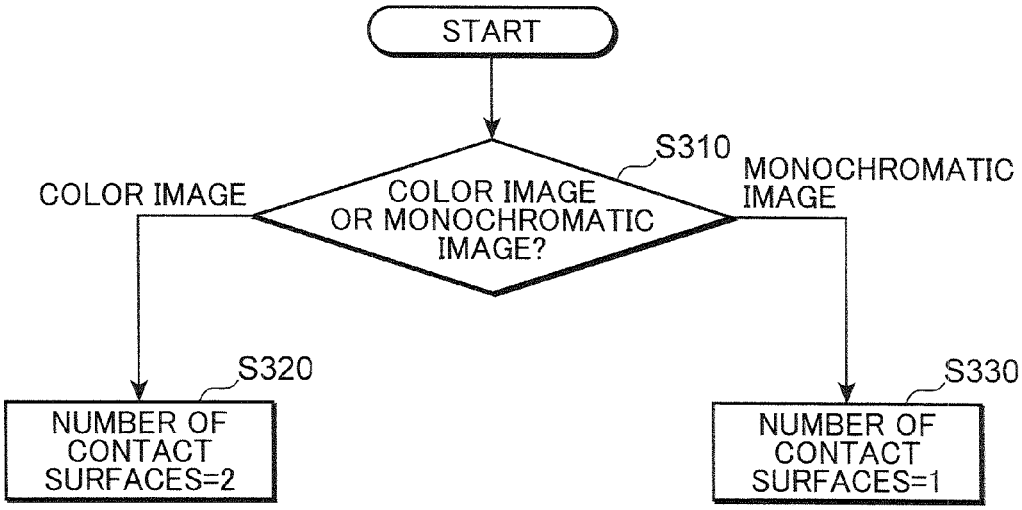
FIG. 21 is a schematic flowchart of an exemplary routine for determining a number of contact surfaces of the fixing device shown in FIG. 14.

FIG. 21 is a schematic flowchart of an exemplary routine for determining a number of contact surfaces on the basis of the aforementioned experimental results. The routine for determining a number of contact surfaces is described with reference to FIGS. 19 to 21.

(Step S310)

In response to input of image data to the printer 500D, Step S310 is executed. In Step S310, the analyzer 520 determines whether color or monochromatic image printing is requested on the basis of the first discrimination information of the image data. If the color image printing is requested, Step S320 is executed. Otherwise, Step S330 is executed.

(Step S320)

In Step S320, the analyzer 520 determines to set a number of the contact surfaces to two. The determination of the analyzer 520 is output to the controller 530. The controller 530 displaces the upstream and downstream rubbing rollers 723, 724 to a contact position for setting the number of the contact surfaces to two.

(Step S330)

In Step S330, the analyzer 520 determines to set a number of the contact surfaces to one. The determination of the analyzer 520 is output to the controller 530. The controller 530 displaces one of the upstream and downstream rubbing rollers 723, 724 to a spaced position for setting the number of the contact surfaces to one.

In the present embodiment, a number of the contact surfaces is ranged from zero to two. Alternatively, there may be three or more rubbing portions. An increase in a number of rubbing portions increases a selection range for a number of contact surfaces.

The analyzer 520 may determine a number of contact surfaces in response to a printing ratio before the execution of Step S320 and/or Step S330. A large number of contact surfaces may be set as the printing ratio increases. If the printing ratio is low, the analyzer 520 may set a small number of contact surfaces.

<Image Forming Process>

Figure 22:
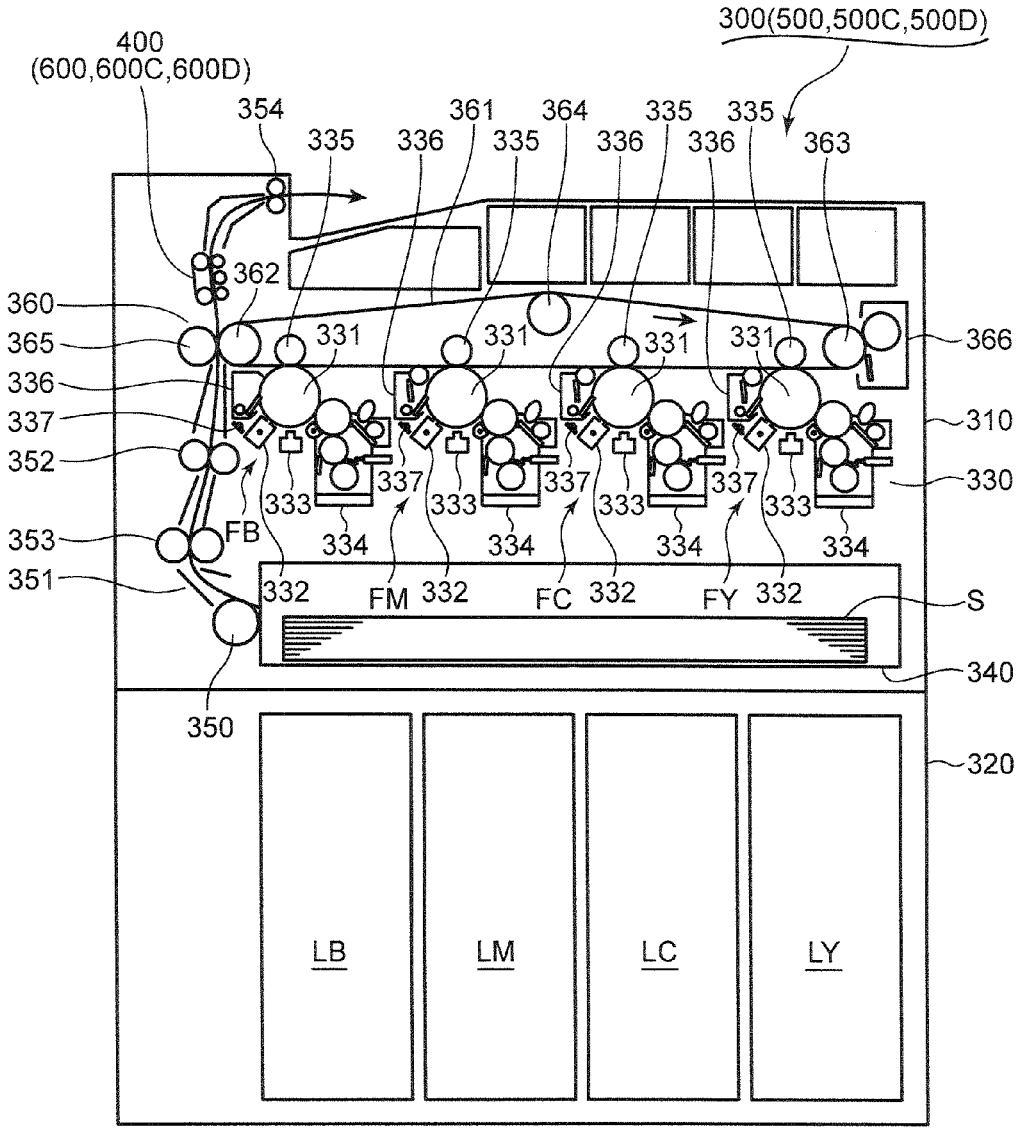
FIG. 22 is a schematic view of a color printer exemplified as an image forming apparatus.

FIG. 22 is a schematic view of a color printer 300 exemplified as the printers 500, 500C, 500D. An image forming process using the color printer 300 is described with reference to FIGS. 7, 13 and 22.

The color printer 300 is provided with an upper housing 310 configured to store various devices and components for forming images, and a lower housing 320 below the upper housing 310. The color printer 300 is further provided with circulation devices LY, LC, LM, LB for circulating liquid developers. The circulation devices LY, LC, LM, LB are stored in the lower housing 320. The circulation device LY circulates yellow liquid developer. The circulation device LC circulates cyan liquid developer. The circulation device LM circulates magenta liquid developer. The circulation device LB circulates black liquid developer for forming a black component image in the image.

The color printer 300 is provided with an image forming section 330 configured to form an image by means of liquid developer. The image forming section 330 includes an image forming unit FY configured to form an image by means of yellow liquid developer, an image forming unit FC configured to form an image by means of cyan liquid developer, an image forming unit FM configured to form an image by means of magenta liquid developer, and an image forming unit FB configured to form an image by means of black liquid developer. The image forming units FY, FC, FM, FB are situated in the upper housing 310. The yellow liquid developer is circulated between the circulation device LY and the image forming unit FY. The cyan liquid developer is circulated between the circulation device LC and the image forming unit FC. The magenta liquid developer is circulated between the circulation device LM and the image forming unit FM. The black liquid developer is circulated between the circulation device LB and the image forming unit FB. Any technologies for circulating liquid developer which are used in conventional image forming apparatuses may be applied to principles of circulating liquid developers by the circulation devices LY, LC, LM, LB as appropriate. Therefore, pipes for connecting the circulation devices LY, LC, LM, LB to the image forming units FY, FC, FM, FB are not shown in FIG. 22.

The color printer 300 is further provided with a cassette 340 configured to accommodate sheets S, and a sheet feeding mechanism 350 configured to feed the sheets S from the cassette 340. A sheet feeding structure for an image forming apparatus such as a general printer or copier may be applied to the sheet feeding mechanism 350 configured to feed the sheets S from the cassette 340. The sheet feeding mechanism 350 is used as a part of the conveying mechanism 540.

The color printer 300 is further provided with a transfer mechanism 360 configured to transfer images formed by the image forming units FY, FC, FM, FB onto a sheet S. The upper housing 310 defines a sheet conveyance path 351 extending upwardly from the sheet feeding mechanism 350 toward the transfer mechanism 360. The sheet S is guided along the sheet conveyance path 351, and conveyed toward the transfer mechanism 360.

The color printer 300 is further provided with a registration roller pair 352 configured to feed the sheet S to the transfer mechanism 360 in synchronism with a transfer timing of an image onto the sheet S by the transfer mechanism 360, and a conveying roller pair 353 configured to feed the sheet S from the sheet feeding mechanism 350 to the registration roller pair 352. The sheet S fed from the cassette 340 by the sheet feeding mechanism 350 is sent to an upper position of the image forming apparatus by the conveying roller pair 353. The registration roller pair 352 then adjusts a conveyance timing of the sheet S, and feeds the sheet S to the transfer mechanism 360. The transfer mechanism 360 transfers the images formed by the image forming units FY, FC, FM, FB onto the sheet S. The registration roller pair 352 and the conveying roller pair 353 are used as a part of the conveying mechanism 540.

The color printer 300 is further provided with a fixing device 400 configured to fix an image transferred by the transfer mechanism 360 onto the sheet S, and a discharge mechanism 354 configured to discharge the sheet S from the upper housing 310. The fixing device 400 rubs the image on the sheet S. The discharge mechanism 354 then discharges the sheet S from the upper housing 310. It should be noted that the fixing device 400 is one of the fixing devices 600, 600C, 600D.

During conveyance of a sheet S from the registration roller pair 352 to the fixing device 400, the transfer mechanism 360 transfers an image onto the sheet S. The transfer mechanism 360 is provided with a transfer belt 361 configured to sequentially transfer images by the image forming units FY, FC, FM, FB, a drive roller 362 configured to drive the transfer belt 361, an idler 363 configured to define a travel path of the transfer belt 361 in cooperation with the drive roller 362, a tension roller 364 configured to apply tension to the transfer belt 361 for stabilizing travel of the transfer belt 361, a transfer belt 365 configured to press the transfer belt 361 wound around the drive roller 362, and a cleaning device 366 configured to clean the transfer belt 361. The registration roller pair 352 feeds the sheet S between the transfer roller 365 and the transfer belt 361 which is wound around the drive roller 362.

The image forming units FY, FC, FM, FB are situated along the lower surface of the transfer belt 361. The image forming unit FY transfers an image formed by yellow liquid developer onto the transfer belt 361. The transfer belt 361 is then moved to an image transfer position by the image forming unit FC with carrying the image formed by yellow liquid developer. The image forming unit FC transfers an image formed by cyan liquid developer onto the transfer belt 361. Accordingly, the image formed by the cyan liquid developer is laid over the image formed by the yellow liquid developer. The transfer belt 361 is then moved to an image transfer position by the image forming unit FM with carrying the images formed by the yellow and cyan liquid developers. The image forming unit FM transfers an image formed by magenta liquid developer onto the transfer belt 361. Accordingly, the image formed by the magenta liquid developer is laid over the images formed by the yellow and cyan liquid developers. The transfer belt 361 is then moved to an image transfer position by the image forming unit FB with carrying the images formed by yellow, cyan and magenta liquid developers. The image forming unit FB transfers an image formed by black liquid developer onto the transfer belt 361. Accordingly, the yellow, cyan, magenta and black images transferred onto the transfer belt 361 from the image forming units FY, FC, FM, FB are superimposed on the transfer belt 361 and become a full-color image. The full-color image on the transfer belt 361 is transferred onto the sheet S fed between the transfer roller 365 and the transfer belt 361 which is wound around the drive roller 362.

Each of the image forming units FY, FC, FM, FB is provided with a photoreceptor drum 331, a charger 332 configured to substantially uniformly charge the surface of the photoreceptor drum 331, and an exposure device 333 configured to emit laser light to the charged surface of the photoreceptor drum 331. The photoreceptor drum 331 rotates so that a linear velocity (a tangential speed on the surface of the photoreceptor drum 331) becomes 0.1 m/sec. As described above, the charger 332 generates a surface potential of 400V on the surface of the photoreceptor drum 331. As a result of rotation of the photoreceptor drum 331, the photoreceptor drum 331 charged by the charger 332 is moved to a laser light emission position by the exposure device 333. The exposure device 333 emits laser light to the surface of the photoreceptor drum 331 in response to image data transmitted from an external device (not shown, for instance, a personal computer). Accordingly, an electrostatic latent image corresponding to the image data is formed on the surface of the photoreceptor drum 331.

Each of the image forming units FY, FC, FM, FB is further provided with a developing device 334 configured to apply liquid developer onto the surface of the photoreceptor drum 331. As a result of rotation of the photoreceptor drum 331, the surface of the photoreceptor drum 331 carrying an electrostatic latent image is moved to a liquid developer application position by the developing device 334. The developing device 334 applies liquid developer onto the photoreceptor drum 331 with application of a developing bias voltage of 300V to develop the electrostatic latent image on the surface of the photoreceptor drum 331. The developing device 334 may be a well-known developing device configured to develop an electrostatic latent image by means of liquid developer. Yellow liquid developer is circulated between the developing device 334 of the image forming unit FY and the circulation device LY. Cyan liquid developer is circulated between the developing device 334 of the image forming unit FC and the circulation device LC. Magenta liquid developer is circulated between the developing device 334 of the image forming unit FM and the circulation device LM. Black liquid developer is circulated between the developing device 334 of the image forming unit FB and the circulation device LB.

Each of the image forming units FY, FC, FM, FB is further provided with a transfer roller 335 configured to transfer an image developed on the photoreceptor drum 331 onto the transfer belt 361. The transfer belt 361 is passed between the transfer roller 361 and the photoreceptor drum 331. The transfer roller 335 presses the transfer belt 361 against the surface of the photoreceptor drum 331. A voltage having an opposite polarity (negative polarity, in the present embodiment) to that of the colored particles P on the photoreceptor drum 331 is applied from a power source (not shown) to the transfer roller 335. To the transfer belt 361, the transfer roller 335 applies the voltage with the opposite polarity to that of the toner. Accordingly, the colored particles P and the polymer compounds are attracted to the outer surface of the electrically-conductive transfer belt 361. Thus, the image formed on the surface of the photoreceptor drum 331 is transferred to the outer surface of the transfer belt 361. Thereafter, the transfer belt 361 carries and conveys the toner image to the sheet S.

Each of the image forming units FY, FC, FM, FB is further provided with a cleaning device 336 configured to remove the liquid developer from the photoreceptor drum 331. After the image transfer onto the transfer belt 361, the surface of the photoreceptor drum 331 faces the cleaning device 336 due to rotation of the photoreceptor drum 331. The cleaning device 336 removes the liquid developer remaining on the surface of the photoreceptor drum 331.

Each of the image forming units FY, FC, FM, FB is further provided with a neutralizer 337 configured to neutralize the surface of the photoreceptor drum 331. The surface of the photoreceptor drum 331 subjected to the cleaning operation by the cleaning device 336 is moved to a neutralization position by the neutralizer 337 due to rotation of the photoreceptor drum 331. The neutralizer 337 neutralizes the surface of the photoreceptor drum 331. The surface of the photoreceptor drum 331 is then charged again by the charger 332. Thereafter, the image forming process is performed again so that another image is transferred onto the transfer belt 361.

As a result of image transfer by the image forming units FY, FC, FM, FB, a full-color image is carried onto the transfer roller 365 by the transfer belt 361. Since a sheet S is fed at an appropriate timing between the transfer roller 365 and the transfer belt 361, which is wound around the drive roller 362, the image is transferred on the sheet S in position. The surface of the transfer belt 361 carrying the transferred toner image on the sheet S is then moved so as to face the cleaning device 366. The cleaning device 366 removes the liquid developer remaining on the transfer belt 361. Thereafter, the surface of the transfer belt 361 subjected to the cleaning operation by the cleaning device 366 is passed between the transfer roller 335 and the photoreceptor drum 331 for another image transfer.

<Liquid Developer>

The aforementioned fixation principle is preferably applied to an image formed using the following exemplary liquid developer. In the following, various components of liquid developer are exemplified.

The liquid developer includes the electrically insulating carrier liquid C and the colored particles P dispersed in the carrier liquid C. This liquid developer also contains the polymer compounds R. The liquid developer preferably has viscosity of 30 to 400 mPa·s at a measurement temperature of 25° C. The viscosity of the liquid developer (at the measurement temperature of 25° C.) is preferably 40 to 300 mPa·s, and more preferably 50 to 250 mPa·s.

(Carrier Liquid)

The electrically insulating carrier liquid C which works as liquid carrier enhances electrical insulation of the liquid developer. For example, electrically insulating organic solvent having a volume resistivity of 1012 Ω·cm or above at 25° C. (i.e., an electrical conductivity of 1.0 pS/cm or lower) is preferably used as the electrically insulating carrier liquid C. In addition, carrier liquid, which may further dissolve the following polymer compounds R, is preferably used (the one with relatively high solubility for the polymer compounds R).

The viscosity and type of the carrier liquid C as well as the compounding amount therein are appropriately adjusted and selected in order to obtain the 30 to 400 mPa·s viscosity (at the measuring temperature of 25° C.) in the entire liquid developer. The viscosity of the liquid developer depends on a combination of the organic solvent used as the carrier liquid C and the organic polymer compounds R, which is described hereinafter. Therefore, the type and compounding amount of the organic solvent are appropriately determined in response to desired viscosity of the liquid developer and a selected type of polymer compounds R.

Aliphatic hydrocarbons and vegetable oil, which are liquid at an ordinary temperature, are exemplified as the electrically insulating organic solvent.

Liquid n-paraffinic hydrocarbons, iso-paraffinic hydrocarbons, halogenated aliphatic hydrocarbons, branched aliphatic hydrocarbons, and a mixture thereof are exemplified as the aliphatic hydrocarbons. For example, n-hexane, n-heptane, n-octane, nonane, decane, dodecane, hexadecane, heptadecane, cyclohexane, perchloroethylene, trichloroethane, and alike may be used as the aliphatic hydrocarbons. Nonvolatile organic solvent and organic solvent of relatively low volatility (e.g., with a boiling point of 200° C. or higher) are preferred in terms of environmental responsiveness (VOC measures). In addition, liquid paraffins which include a relatively large amount of aliphatic hydrocarbon with 16 or more carbon atoms may be preferably used.

Tall oil fatty acid (major components: oleic acid, linoleic acid), vegetable oil-based fatty acid ester, soybean oil, sunflower oil, castor oil, flaxseed oil, and tung oil are exemplified as the vegetable oil. The tall oil fatty acid and alike among them are preferably used.

Liquid paraffins "Moresco White P-55", "Moresco White P-40", "Moresco White P-70", and "Moresco White P-200" manufactured by Matsumura Oil Co., Ltd.; tall oil fatty acids "Hartall FA-1", "Hartall FA-1P", and "Hartall FA-3" manufactured by Harima Chemicals, Inc.; vegetable oil-based solvents "Vege-Sol™ MT", "Vege-Sol™ CM", "Vege-Sol™ MB", "Vege-Sol™ PR", and tung oil manufactured by Kaneda Co., Ltd.; "Isopar™ G", "Isopar™ H", "Isopar™ K", "Isopar™ L", "Isopar™ M "and "Isopar™ V" manufactured by ExxonMobil Corporation; liquid paraffins "Cosmo White P-60", "Cosmo White P-70", and "Cosmo White P-120" manufactured by Cosmo Oil Co., Ltd.; vegetable oils "refined soybean oil S", "flaxseed oil", and "sunflower oil" manufactured by The Nisshin Oillio Group, Ltd.; and "castor oil LAV" and "castor oil I" manufactured by Ito Oil Chemicals Co., Ltd. are exemplified as the carrier liquid C.

Any carrier liquid C may be used as long as it dissolves the polymer compounds R. In other words, the one with relatively high solubility for the polymer compounds R (the one which dissolves the polymer compounds R successfully) may be used alone as the carrier liquid C, or it may be combined with the one with relatively low solubility for the polymer compounds R (the one that poorly dissolves the polymer compounds R). It should be noted that electrical conductivity of the entire carrier liquid C (the electrical conductivity of the liquid developer) is adjusted according to a type of the carrier liquid C so that the electrical conductivity of the liquid developer does not becomes excessively high. For instance, vegetable oils such as tall oil fatty acids generally have higher electrical conductivity than the aliphatic hydrocarbons such as liquid paraffins. Therefore, if the aforementioned vegetable oils are included as the carrier liquid C in order to successfully dissolve the polymer compounds R in the carrier liquid C, the electrical conductivity should be carefully adjusted.

Carrier liquid C which has a greater amount of the aforementioned oil is more advantageous in terms of the solubility for the polymer compounds R whereas it may be disadvantageous in terms of the electrical conductivity. Carrier liquid C which has a fewer amount of the aforementioned oil is more advantageous in terms of the electrical conductivity whereas it may be disadvantageous in terms of the solubility for the polymer compounds R.

As described above, contents of the aforementioned oils in the entire carrier liquid C depends on types and contents of the polymer compounds R contained in the liquid developer, and are preferably, for example, 2 to 80 mass %, and more preferably 5 to 60 mass %. It becomes difficult to successfully dissolve the polymer compounds R in the carrier liquid C if contents of the oils is less than 2 mass %. The electrical conductivity of the entire carrier liquid C and the liquid developer becomes excessively high if the contents of the oils exceeds 80 mass %. The excessively high electrical conductivity of the liquid developer leads to low image density.

The electrical conductivity of the liquid developer is preferably, for example, 200 pS/cm or lower. Therefore, the electrical conductivity of the entire carrier liquid C (the electrical conductivity of the liquid developer) is preferably adjusted to, for example, 200 pS/cm or lower by mixing a highly electrically resistant aliphatic hydrocarbon with resultant solution from dissolving the polymer compounds R in the oils such as tall oil fatty acids (often referred to as "resin solvent" hereinafter).

(Colored Particles)

In the present embodiment, pigment itself is used as the colored particles P. Liquid developer containing pigment itself enables the aforementioned non-thermal fixing method. As a result, the pigment as the colored particles P is fixed onto a recording medium with no or less consumption of heat energy or light energy.

For example, known organic or inorganic pigment may be used for the pigment according to the present embodiment in non-limiting manner.

For example, conventionally known organic pigment or inorganic pigment may be used as the pigment of the present embodiment without any limitation. Azine dyes such as carbon black, oil furnace black, channel black, lampblack, acetylene black, and aniline black, metal salt azo dyes, metallic oxides, and combined metal oxides are exemplified as black pigment. Pigment Yellow 74, Cadmium yellow, mineral fast yellow, nickel titanium yellow, navels yellow, naphthol yellow S, hansa yellow G, hansa yellow 10G, benzidine yellow GR, quinoline yellow lake, permanent yellow NCG, and tartrazine lake are exemplified as yellow pigment. Molybdenum orange, permanent orange GTR, pyrazolone orange, Vulcan orange, indanthrene brilliant orange RK, benzidine orange G, and indanthrene brilliant orange GK are exemplified as orange pigment. Pigment Red 57:1, Colcothar, cadmium red, permanent red 4R, lithol red, pyrazolone red, watching red calcium salt, lake red D, brilliant carmine 6B, eosin lake, rhodamine lake B, alizarin lake, and brilliant carmine 3B are exemplified as red pigment. Fast violet B and methyl violet lake are exemplified as purple pigment. C.I. Pigment Blue 15:3, cobalt blue, alkali blue, Victoria blue lake, phthalocyanine blue, non-metal phthalocyanine blue, partial chloride of phthalocyanine blue, fast sky blue, and indanthrene blue BC are exemplified as blue pigment. Chrome green, chromium oxide, pigment green B, and malachite green lake are exemplified as green pigment.

Contents of each pigment in the liquid developer are preferably 1 to 30 mass %, more preferably 3 mass % or more, and more preferably 5 mass % or more. The contents of each pigment are also more preferably 20 mass % or less, and more preferably 10 mass % or less.

An average particle diameter of each pigment in the liquid developer, which is a volume basis median diameter (D50), is preferably 0.1 to 1.0 μm. The average particle diameter less than 0.1 μm leads to, for example, low image density. The average particle diameter above 1.0 μm leads to, for example, low fixation properties. The volume basis median diameter (D50) here generally denotes a particle diameter at the point where a cumulative curve based on the total volume 100% of one group of particles with a determined particle distribution attains 50%.

(Dispersion Stabilizer)

The liquid developer according to the present embodiment may contain dispersion stabilizer for facilitating and stabilizing dispersion of the particles in the liquid developer. Dispersion stabilizer "BYK-116" manufactured by BYK Co., Ltd., for example, may be suitably used as the dispersion stabilizer according to the present embodiment. In addition, "Solsperse 9000," "Solsperse 11200," "Solsperse 13940," "Solsperse 16000," "Solsperse 17000, and "Solsperse 18000" manufactured by The Lubrizol Corporation, and "Antaron™ V-216" and "Antaron™ V-220" manufactured by International Specialty Products, Inc. may be preferably used.

Contents of the dispersion stabilizer in the liquid developer are approximately 1 to 10 mass %, and preferably approximately 2 to 6 mass %.

(Polymer Compounds)

The polymer compounds R contained in the liquid developer according to the present embodiment are organic polymer compounds such as cyclic olefin copolymer, styrene elastomer, cellulose ether and polyvinyl butyral. A material which increases viscosity of the liquid developer to prevent bleeding during the image formation may be selected as the organic polymer compounds with high solubility for the carrier liquid C. A cyclic olefin copolymer, styrene elastomer, cellulose ether, and polyvinyl butyral are exemplified as the organic polymer compounds. Preferably, styrene elastomer is used as the organic polymer compounds. A single type of organic polymer compound or several types of organic polymer compounds may be used as the polymer compounds R.

The liquid developer of the present embodiment contains the polymer compounds dissolved in the carrier liquid C. The organic polymer compounds dissolved in the carrier liquid C may be gel-like polymer compounds. Depending on types and molecular weights of the organic polymer compounds, the organic polymer compounds are mutually entwined in the carrier liquid C and form gel. The gel-like organic polymer compounds have a low fluidity. For example, if concentration of the organic polymer compounds is high or if affinity of the organic polymer compounds for the carrier liquid C is low or if the ambient temperature is low, the organic polymer compounds are likely to form gel. On the other hand, the organic polymer compounds, which hardly entwine mutually in the carrier liquid C, become flowable solution.

Contents of the organic polymer compounds in the liquid developer are appropriately determined according to a type of the organic polymer compounds. The contents of the organic polymer compounds are preferably, for example, 1 to 10 mass %.

If the contents of the polymer compounds are less than 1 mass %, sufficient viscosity may not be obtained in the liquid developer, which may ineffectively prevent bleeding during the image formation. The contents of the polymer compounds exceeding 10 mass % leads to formation of an excessively thick film of the organic polymer compounds on the surface of the sheet S, which significantly deteriorates drying characteristics of the film, increases adherence (tackiness) of the film, and worsens scratch resistance of the image.

The organic polymer compounds which may be preferably used in the present embodiment are described hereinafter in more detail.

(Cyclic Olefin Copolymer)

Cyclic olefin copolymer is amorphous, thermoplastic cyclic olefin resin which has a cyclic olefin skeleton in its main chain without environmental load substances and is excellent in transparency, lightweight properties, and low water absorption properties. The cyclic olefin copolymer of the present embodiment is an organic polymer compound with a main chain composed of a carbon-carbon bond, in which at least a part of the main chain has a cyclic hydrocarbon structure. The cyclic hydrocarbon structure is introduced by using, as a monomer, a compound having at least one olefinic double bond in the cyclic hydrocarbon structure (cyclic olefin), such as norbornene and tetracyclododecene.

Examples of the cyclic olefin copolymer that may be used in the present embodiment include (1) cyclic olefin-based addition (co) polymer or its hydrogenated product, (2) an addition copolymer of a cyclic olefin and an α-olefin, or its hydrogenated product, and (3) a cyclic olefin-based ring-opening (co) polymer or its hydrogenated product.

Specific examples of the cyclic olefin copolymer are as follows:

(a) Cyclopentene, cyclohexane, cyclooctene;

(b) Cyclopentadiene, 1,3-cyclohexadiene and other one-ring cyclic olefins;

(c) Bicyclo[2.2.1]hept-2-ene(norbornene), 5-methyl-bicyclo[2.2.1]hept-2-ene, 5,5-dimethyl-bicyclo[2.2.1]hept-2-ene, 5-ethyl-bicyclo [2.2.1]hept-2-ene, 5-butyl-bicyclo[2.2.1]hept-2-ene, 5-ethylidene-bicyclo [2.2.1]hept-2-ene, 5-hexyl-bicylo[2.2.1]hept-2-ene, 5-octyl-bicyclo[2.2.1]hept-2-ene, 5-octadecyl-bicylo[2.2.1]hept-2-ene, 5-methylidene-bicyclo[2.2.1]hept-2-ene, 5-vinyl-bicyclo [2.2.1]hept-2-ene, 5-propenyl-bicyclo[2.2.1]hept-2-ene, and other two-ring cyclic olefins;

(d) Tricyclo[4.3.0.12,5]deca-3,7-diene(dicyclopentadiene), tricyclo[4.3.0.12,5]deca-3-ene;

(e) Tricyclo[4.4.0.12,5]undeca-3,7-diene or tricyclo[4.4.0.12,5]undeca-3,8-diene or tricyclo[4.4.0.12,5]undeca-3-ene that is a partially hydrogenated product (or an adduct of cyclopentadiene and cyclohexane) thereof;

(f) 5-cyclopentyl bicyclo[2.2.1]hept-2-ene, 5-cyclohexyl-bicyclo [2.2.1]hept-2-ene, 5-cyclohexenyl bicyclo[2.2.1]hept-2-ene, 5-phenyl-bicyclo[2.2.1]hept-2-ene, and other three-ring cyclic olefins;

(g) Tetracyclo[4.4.0.12,5.17,10]dodeca-3-ene(tetracyclododecene), 8-methyltetracyclo[4.4.0.12,5.17,10]dodeca-3-ene, 8-ethyltetracyclo [4.4.0.12,5.17,10]dedeca-3-ene, 8-methylidenetetracyclo [4.4.0.12,5.17,10]dodeca-3-ene, 8-ethylidenetetracyclo [4.4.0.12,5.17,10]dodeca-3-ene, 8-vinyltetracyclo[4.4.0.12,5.17,10]dodeca-3-ene, 8-propenyl-tetracyclo[4.4.0.12,5.17,10]dodeca-3-ene, and other four-ring cyclic olefins;

(h) 8-cyclopentyl-tetracyclo[4.4.0.12,5.17,10]dodeca-3-ene, 8-cyclohexyl-tetracyclo[4.4.0.12,5.17,10]dodeca-3-ene, 8-cyclohexenyl-tetracyclo[4.4.0.12,5.17,10]dodeca-3-ene, and 8-phenyl-cyclopentyl-tetracyclo[4.4.0.12,5.17,10]dodeca-3-ene;

(i) Tetracyclo[7.4.13,6.01,9.02,7]tetradeca-4,9,11,13-tetraene (1,4-methano-1,4,4a,9a-tetrahydrofluorene), tetracyclo [8.4.14,7.01,10.03,8]pentadeca-5,10,12,14-tetraene (1,4-methano-1,4, 4a, 5,10, 10a-hexahydroanthracene);

(j) Pentacyclo[6.6.1.13,6.02,7.09,14]-4-hexadecene, pentacyclo [6.5.1.13,6.02,7.09,13]-4-pentadecene, pentacyclo [7.4.0.02,7.13,6.110,13]-4-pentadecene, heptacyclo

[8.7.0.12,9.14,7.111,17.03,8.012,16]-5-eicosene, heptacyclo [8.7.0.12,9.03,8.14,7.012,17.113,16]-14-eicosene; and (k) Polycyclic olefins such as tetramers of cyclopentadiene. These cyclic olefins may be used alone or in combinations of two or more thereof.

An α-olefin having 2 to 20 carbon atoms, and preferably 2 to 8 carbon atoms is preferable for the abovementioned α-olefin. Specific examples thereof include ethylene, propylene, 1-butene, 1-pentene, 1-hexene, 3-methyl-1-butene, 3-methyl-1-pentene, 3-ethyl-1-pentene, 4-methyl-1-pentene, 4-methyl-1-hexene, 4,4-dimethyl-1-hexene, 4,4-dimethyl-1-pentene, 4-ethyl-1-hexene, 3-ethyl-1-hexene, 1-octene, 1-decene, 1-dodecene, 1-tetradecene, 1-hexadecene, 1-octadecene, and 1-eicosene. These α-olefins may be used alone or in combinations of two or more thereof.

A method for polymerizing cyclic olefins, a method for polymerizing cyclic olefins with α-olefins, and a method for hydrogenating the resultant polymer are not particularly limited and may be carried out according to well-known methods.

The structure of the cyclic olefin copolymer is not particularly limited and may be linear, branched or crosslinked. The linear cyclic olefin copolymer may be preferable.

A copolymer of norbornene and ethylene, or of tetracyclododecene and ethylene may be preferably used as the cyclic olefin copolymer. Copolymer of norbornene and ethylene is more preferred. In this case, contents of norbornene in the copolymer is preferably 60 to 82 mass %, more preferably 60 to 79 mass %, yet more preferably 60 to 76 mass %, and most preferably 60 to 65 mass %. If the contents of norbornene is less than 60 mass %, a glass transition temperature of the cyclic olefin copolymer film may become excessively low, which may lead to a risk of lowering film formation properties of the cyclic olefin copolymer. If the contents of norbornene exceeds 82 mass %, the glass transition temperature of the cyclic olefin copolymer film may become excessively high, which may lead to a risk of lowering fixation properties of pigments, that is, fixation properties of images by the film of the cyclic olefin copolymer. Or the solubility of the cyclic olefin copolymer for the carrier liquid C may be reduced.

A commercially available cyclic olefin copolymer may be used. Examples of the copolymer of norbornene and ethylene include "TOPAS™ TM" (norbornene content: approximately 60 mass %), "TOPAS™ TB" (norbornene content: approximately 60 mass %), "TOPAS™ 8007" (norbornene content: approximately 65 mass %), "TOPAS™ 5013" (norbornene content: approximately 76 mass %), "TOPAS™ 6013" (norbornene content: approximately 76 mass %), "TOPAS™ 6015" (norbornene content: approximately 79 mass %), and "TOPAS™ 6017" (norbornene content: approximately 82 mass %), which are manufactured by TOPAS Advanced Polymers GmbH. These copolymers may be used alone or in combinations of two or more thereof, depending on the circumstances.

(Styrene Elastomer)

A conventionally known styrene elastomer may be used as the polymer compounds R in the present embodiment without any restrictions. Specific examples thereof include a block copolymer composed of an aromatic vinyl compound and a conjugated diene compound or olefinic compound. Examples of the block copolymer include a block copolymer that has a structure expressed by Chemical Formula 1 where A is a polymer block composed of an aromatic vinyl compound and B is a polymer block composed of an olefinic compound or a conjugated diene compound.

(Chemical Formula 1)

$$[A—B]_x—A \quad [C1]$$

(Where x represents an integer chosen such that the number molecular average weight ranges from 1,000 to 100,000.)

Examples of the aromatic vinyl compound constituting the aforementioned block copolymer include styrene, α-methylstyrene, o-methylstyrene, m-methylstyrene, p-methylstyrene, 2,3-dimethylstyrene, 2,4-dimethylstyrene, monochlorostyrene, dichlorostyrene, p-bromostyrene, 2,4,5-tribromostyrene, 2,4,6-tribromostyrene, o-tert-butylstyrene, m-tert-butylstyrene, p-tert-butylstyrene, ethylstyrene, vinylnaphthalene, and vinylanthracene.

The polymer block A may be composed of one or two or more types of the aforementioned aromatic vinyl compounds. The one composed of styrene and/or α-methylstyrene among these aromatic vinyl compounds provides suitable properties for the liquid developer of the present embodiment.

Examples of the olefinic compound constituting the aforementioned block copolymer include ethylene, propylene, 1-butene, 2-butene, isobutene, 1-pentene, 2-pentene, cyclopentene, 1-hexene, 2-hexene, cyclohexene, 1-heptene, 2-heptene, cycloheptene, 1-octene, 2-octene, cyclooctene, vinylcyclopentene, vinylcyclohexene, vinylcycloheptene, and vinylcyclooctene.

Examples of the conjugated diene compound constituting the block copolymer include butadiene, isoprene, chloroprene, 2,3-dimethyl-1,3-butadiene, 1,3-pentadien, and 1,3-hexadien.

The polymer block B may be composed of one or two or more types of each of the olefinic compounds and the conjugated diene compounds. The one composed of butadiene and/or isoprene among these compounds provides suitable properties for the liquid developer of the present embodiment.

Specific examples of the aforementioned block copolymer include a polystyrene-polybutadiene-polystyrene triblock copolymer or its hydrogenated product, polystyrene-polyisoprene-polystyrene triblock copolymer or its hydrogenated product, polystyrene-poly (isoprene/butadiene)-polystyrene triblock copolymer or its hydrogenated product, poly(α-methylstyrene)-polybutadiene-poly(α-methylstyrene)triblock copolymer or its hydrogenated product, poly (α-methylstyrene)-polyisoprene-poly(α-methylstyrene)triblock copolymer or its hydrogenated product, poly(α-methylstyrene)-poly (isoprene/butadiene)-poly(α-methylstyrene)triblock copolymer or its hydrogenated product, polystyrene-polyisobutene-polystyrene triblock copolymer, and poly(α-methylstyrene)-polyisobutene-poly(α-methylstyrene)triblock copolymer.

It is preferred to use a styrene-butadiene elastomer (SBS) with a structure, in which the polymer block A and polymer block B are expressed by Chemical Formula 2, as the styrene elastomer.

(Chemical Formula 2)

[C2]

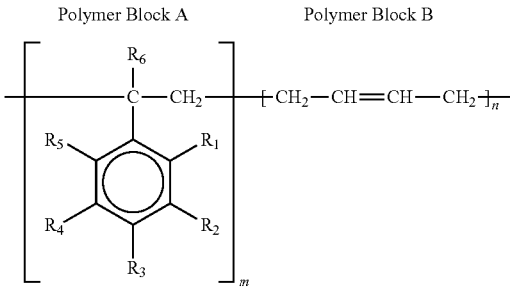

(where $R_1$, $R_2$, $R_4$, $R_5$ and $R_6$ each represent a hydrogen atom or methyl group; $R_3$ represents a hydrogen atom, a halogen atom, a phenyl group or a saturated alkyl group, a methoxy group or ethoxy group having 1 to 20 carbon atoms; and m, n each represent an integer chosen such that the content of the polymer block A ranges from 5 to 75 mass %.)

The styrene-butadiene elastomer is obtained by copolymerizing styrene monomer and butadiene, which is the conjugated diene compound. Examples of preferred styrene monomer include styrene, α-methylstyrene, o-methylstyrene, m-methylstyrene, p-methylstirene, p-ethylstyrene, 2,4-dimethylstyrene, p-n-butylstyrene, p-dodecylstyene, p-methoxystyrene, p-phenylstyrene, and p-chlorostyrene.

The aforementioned styrene-butadiene elastomer has a number average molecular weight Mn in a range of, preferably, 1,000 to 100,000 (c.f., Chemical Formula 1) and more preferably 2,000 to 50,000, in a molecular weight distribution measured by means of a GPC (gel permeation chromatography). A weight-average molecular weight Mw of the styrene-butadiene elastomer is in a range of, preferably, 5,000 to 1,000,000 and more preferably 10,000 to 500,000. In this case, at least one peak is present in the weight-average molecular weight Mw range of 2,000 to 200,000 and preferably in the weight-average molecular weight Mw range of 3,000 to 150,000.

In the aforementioned styrene-butadiene elastomer, a value of ratio (weight-average molecular weight Mw/number average molecular weight Mn) may be preferably equal to or lower than 3.0, and more preferably equal to or lower than 2.0.

Contents of styrene in the aforementioned styrene-butadiene elastomer (the contents of the polymer block A) are in a range of, preferably, 5 to 75 mass % (c.f., Chemical Formula 2) and more preferably 10 to 65 mass %. If the styrene contents are less than 5 mass %, a glass transition temperature of the styrene elastomer film becomes excessively low and deteriorates the film formation properties of the styrene elastomer. If the styrene contents exceed 75 mass %, a softening point of the styrene elastomer film becomes excessively high and worsens fixation properties of pigments, that is, fixation properties of images due to the styrene elastomer film.

In the present embodiment, a commercially available styrene elastomer may be used. For example, "Klayton" manufactured by Shell, "Asaprene™" T411, T413, T437, "Tufprene™" A, 315P, which are manufactured by Asahi Kasei Chemicals Corporation, and "JSR TR1086," "JSR TR2000," "JSR TR2250" and "JSR TR2827" manufactured by JSR Corporation, may be used as a styrene-conjugated diene block copolymer. "Septon" S1001, S2063, S4055, S8007, "Hybrar" 5127, 7311, which are manufactured by Kuraray Co., Ltd., "Dynaron" 6200P, 4600P, 1320P manufactured by JSR Corporation may be used as a hydrogenated product of the styrene-conjugated diene block copolymer. Also, "Index" manufactured by The Dow Chemical Company may be used as styrene-ethylene copolymer. As other styrene elastomers, "Aron AR" manufactured by Aronkasei Co., Ltd. and "Rabalon" manufactured by Mitsubishi Chemical Corporation may be used. These materials may be used alone or in combinations of two or more types thereof as appropriate.

(Cellulose Ether)

Cellulose ether is a polymer formed by substituting a hydroxyl group of a cellulose molecule with an alkoxy group. The substitution rate is preferably 45 to 49.5%. The alkyl moiety of the alkoxy group may be substituted with, for example, hydroxyl group or alike. A film formed by cellulose ether is excellent in toughness and thermal stability.

Examples of the cellulose ether which may be used in the present embodiment include: alkyl cellulose such as methylcellulose and ethylcellulose; hydroxyalkyl cellulose such as hydroxyethyl cellulose and hydroxypropyl cellulose; hydroxy alkyl alkyl cellulose such as hydroxyethyl methyl cellulose, hydroxypropyl methyl cellulose, and hydroxyethyl ethyl cellulose; carboxy alkyl cellulose such as carboxymethyl cellulose; and carboxy-alkyl hydroxy-alkyl cellulose such as carboxymethyl hydroxyethyl cellulose. These cellulose ethers may be used alone or in combinations of two or more thereof. Alkyl celluloses are preferred among these cellulose ethers. Ethyl celluloses are preferred among these alkyl celluloses.

In the present embodiment, commercially available cellulose ether may be used. Examples of the ethylcellulose include "Ethocel™ STD4," "Ethocel™ STD7," and "Ethocel™ STD10" manufactured by Nissin-Kasei Co., Ltd. These ethyl celluloses may be used alone or in combinations of two or more thereof, depending on the circumstances.

(Polyvinyl Butyral)

As shown in Chemical Formula 3, the polyvinyl butyral (butyral resin: alkyl acetalized polyvinyl alcohol) is a copolymer of a hydrophilic vinyl alcohol unit having a hydroxyl group, a hydrophobic vinyl acetal unit having a butyral group, and a vinyl acetate unit having intermediate properties between a vinyl alcohol unit and vinyl acetal unit and having an acetyl group. Polyvinyl butyral which has a degree of butyralization (the ratio between a hydrophilic moiety and a hydrophobic moiety) between 60 to 85 mol % is preferred in the liquid developer of the present embodiment in terms of its excellent film formation properties (film formation properties). The polyvinyl butyral has a vinyl acetal unit indicating the solubility of the polyvinyl butyral for nonpolar solvent and a vinyl alcohol unit for improving the bonding properties of the recording medium such as paper. Therefore, the polyvinyl butyral has high affinity with both the carrier liquid C and the recording medium.

(Chemical Formula 3)

[C3]

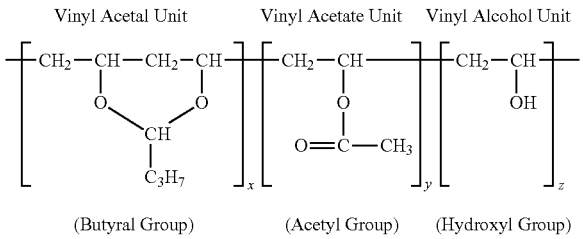

"Mowital™ "B20H, B30B, B30H, B60T, B60H, B60HH and B70H manufactured by Hoechst A G; "S-LEC™" BL-1 (degree of butyralization: 63±3 mol %), BL-2 (degree of butyralization: 63±3 mol %), BL-S (degree of butyralization: 70 mol % or more), BL-L, BH-3 (degree of butyralization: 65±3 mol %), BM-1 (degree of butyralization: 65±3 mol %), BM-2 (degree of butyralization: 68±3 mol %), BM-5 (degree of butyralization: 63±3 mol %) and BM-S, manufactured by Sekisui Chemical Co., Ltd.; and "Denka butyral" #2000-L, #3000-1, #3000-2, #3000-3, #3000-4, #3000-K, #4000-1, #5000-A, and #6000-C manufactured by Denki Kagaku Kogyo K K may be exemplified as the polyvinyl butyral. These polyvinyl butyrals may be used alone or in combinations of two or more thereof.

(Manufacturing Method)

The liquid developer according to the present embodiment may be produced by sufficiently dissolving or mixing/dispersing the carrier liquid C, pigments, polymer compounds and optionally the dispersion stabilizer for several minutes to over 10 hours, as appropriate, by using, for example, a ball mill, sand grinder, Dyno mill, rocking mill or alike (or a media distributed machine using zirconia beads and alike may be used).

Mixing/dispersing these components finely pulverize the pigments. The mixing/dispersion time and the rotating speed of the machine are adjusted so that the average particle diameter (D50) of the pigments in the liquid developer becomes, preferably, 0.1 to 1.0 μm as described above. If the dispersion time is excessively short or if the rotating speed is excessively low, the average particle diameter of the pigments (D50) exceeds 1.0 μm, and deteriorates the fixation properties as described above. If the dispersion time is excessively long or if the rotating speed is excessively high, the average particle diameter of the pigments (D50) becomes less than 0.1 μm, which in turn leads to poor developing properties and low image density.

The liquid developer may be produced by dissolving the polymer compounds in the carrier liquid C and then mixing/dispersing the pigments (with the dispersion stabilizer, as appropriate). The liquid developer may be produced by preparing solution obtained by dissolving the polymer compounds in the carrier liquid C and a pigment dispersion (obtained by mixing/dispersing the pigments in the carrier liquid C (with the dispersion stabilizer, as appropriate)), and then mixing the resin solution with the pigment dispersion at an appropriate mixing ratio (mass ratio).

A particle size distribution needs to be measured in order to calculate the average particle diameter (D50) of the pigments. The particle size distribution of the pigments may be measured as follows.

A given amount of produced liquid developer or prepared pigment dispersion is sampled and diluted to 10 to 100 times of its volume with the same carrier liquid C as the one used in the liquid developer or the pigment dispersion. The particle size distribution of the resultant liquid is measured on the basis of a flow system using a laser diffraction type particle size distribution measuring device "Mastersizer 2000" manufactured by Malvern Instruments Ltd.

The viscosity of the produced liquid developer may be measured at a measurement temperature of 25° C. by using a vibrational viscometer "Viscomate VM-10A-L" manufactured by CBC Co., Ltd.

The aforementioned principles of the embodiments provide a process of rubbing an image under appropriate rubbing conditions. As a result, an image is fixed onto a sheet with a high fixation ratio. In addition, the process of rubbing an image becomes less influential to a sheet conveying operation.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. An image forming apparatus for forming an image on a sheet, comprising:

an acquiring section configured to acquire image information about the image, the image information includes discrimination information for discriminating whether the image to be formed on the sheet is a monochromatic image or a color image;

an image forming section that uses liquid developer to form the image on the sheet in response to the image information;

a fixing device configured to fix the image onto the sheet; and a controller that carries out control to change operation of the fixing device in response to the image information, wherein the fixing device includes a rubbing mechanism configured to rub the image on the sheet, and the rubbing mechanism changes rubbing operation in response to the image information under the control of the controller.

2. The image forming apparatus according to claim 1, wherein the image information further includes printing ratio information about a printing ratio of the image to be formed on the sheet.

3. The image forming apparatus according to claim 2, wherein the controller controls the fixing device to increase a rubbing level for the image by the rubbing mechanism as the printing ratio increases.

4. The image forming apparatus according to claim 1, wherein if the discrimination information represents that the image to be formed on the sheet is the monochromatic image, the controller controls the fixing device so that the rubbing mechanism rubs the image at a first rubbing level, and if the discrimination information represents that the image to be formed on the sheet is the color image, the controller controls the fixing device so that the rubbing mechanism rubs the image at a second rubbing level greater than the first rubbing level.

5. The image forming apparatus according to claim 1, wherein the rubbing mechanism includes a contact surface configured to contact the image on the sheet, and the controller changes a relative speed of the contact surface with respect to a conveying speed of the sheet in response to the image information.

6. The image forming apparatus according to claim 5, wherein the rubbing mechanism includes a rubbing roller configured to press the sheet, the rubbing roller including a circumferential surface on which the contact surface is formed, and the controller changes a rotating speed of the rubbing roller in response to the image information.

7. The image forming apparatus according to claim 5, wherein the rubbing mechanism includes a rubbing belt configured to contact the sheet, a pressing member configured to press the rubbing belt toward the image on the sheet for forming the contact surface on the rubbing belt, and a winder configured to wind the rubbing belt, and the controller controls the winder to change a winding speed of the rubbing belt in response to the image information.

8. The image forming apparatus according to claim 5, wherein the rubbing mechanism includes an annular rubbing band configured to contact the sheet, a pressing member configured to press the annular rubbing band toward the image on the sheet for forming the contact surface on the annular rubbing band, and a circulation mechanism configured to circulate the annular rubbing band, and the controller controls the circulation mechanism to change a circulation speed of the annular rubbing band in response to the image information.

9. The image forming apparatus according to claim 1, wherein the rubbing mechanism includes a contact surface configured to contact the image on the sheet, the fixing device includes a vibration mechanism configured to vibrate the contact surface, and the controller controls the vibration mechanism to change a frequency of the contact surface in response to the image information.

10. The image forming apparatus according to claim 1, wherein the rubbing mechanism includes a first rubbing portion configured to rub the image on the sheet, and a second rubbing portion configured to rub the image after the first rubbing portion, the fixing device includes a spacing mechanism configured to move at least one of the first and second rubbing portions away from the image, and the controller controls the spacing mechanism to move the at least one of the first and second rubbing portions away from the image in response to the image information.

11. The image forming apparatus according to claim 1, wherein the rubbing mechanism includes a contact surface configured to contact the image on the sheet, and the contact surface is covered with unwoven fabric.

12. The image forming apparatus according to claim 1, wherein the liquid developer includes colored particles for coloring the image, carrier liquid in which the colored particles are dispersed, and polymer compounds dissolved or swollen in the carrier liquid.

13. An image forming apparatus for forming an image on a sheet, comprising:

an acquiring section configured to acquire image information about the image, the image information includes discrimination information for discriminating whether the image to be formed on the sheet is a photographic image or not;

an image forming section which uses liquid developer to form the image on the sheet in response to the image information;

a fixing device configured to fix the image onto the sheet; and a controller which carries out control to change operation of the fixing device in response to the image information, wherein the fixing device includes a rubbing mechanism configured to rub the image on the sheet, and the rubbing mechanism changes rubbing operation in response to the image information under the control of the controller.

14. The image forming apparatus according to claim 13, wherein if the discrimination information represents that the image to be formed on the sheet is an image other than the photographic image, the controller controls the fixing device so that the rubbing mechanism rubs the image at a first rubbing level, and if the discrimination information represents that the image to be formed on the sheet is the photographic image, the controller controls the fixing device so that the rubbing mechanism rubs the image at a second rubbing level greater than the first rubbing level.

* * * * *